US006345964B1

(12) United States Patent
Cooper

(10) Patent No.: US 6,345,964 B1
(45) **Date of Patent: *Feb. 12, 2002**

(54) MOLTEN METAL PUMP WITH METAL-TRANSFER CONDUIT MOLTEN METAL PUMP

(76) Inventor: Paul V. Cooper, 11247 Lake Forest Dr., Chesterland, OH (US) 44026

( * ) Notice: Subject to any disclaimer, the term of this patent is extended or adjusted under 35 U.S.C. 154(b) by 0 days.

This patent is subject to a terminal disclaimer.

(21) Appl. No.: 09/275,627

(22) Filed: Mar. 24, 1999

Related U.S. Application Data

(63) Continuation of application No. 08/759,780, filed on Dec. 3, 1996, now Pat. No. 5,944,496.

(51) Int. Cl.[7] ..... F04B 17/03

(52) U.S. Cl. ..... 417/423.3; 417/424.1; 417/32; 417/360

(58) Field of Search ..... 417/360, 424.1, 417/363, 372, 32, 423.9, 292; 416/223 R, 223 A, 223 B, 185; 415/88, 200; 403/383, 220, 337; 464/179; 164/337; 266/235, 239

(56) References Cited

U.S. PATENT DOCUMENTS 209,219 A 10/1878 Bookwalter (List continued on next page.)

FOREIGN PATENT DOCUMENTS

| | | |
|---|---|---|
| CA | 683469 | 3/1964 |
| CH | 392268 | 9/1965 |
| DE | 1800446 | 12/1969 |
| EP | 0665378 | 8/1995 |
| GB | 942648 | 11/1963 |
| GB | 1185314 | 3/1970 |
| GB | 2217784 | 11/1989 |
| JP | 58-048796 | 3/1983 |
| JP | 63-104773 | 5/1998 |
| NO | 90756 | 1/1958 |
| SU | 416401 | 6/1974 |
| SU | 773312 | 10/1980 |
| WO | 9825031 | 6/1998 |

OTHER PUBLICATIONS

Lobanoff, et al. "Centrifugal Pumps Design & Application" Second Edition, pp173–236.

*Primary Examiner*—Ted Kim
(74) *Attorney, Agent, or Firm*—David E. Rogers; Stuart A. Whittington; Squire, Sanders & Dempsey, LLP

(57) ABSTRACT

A molten metal pumping device is disclosed that comprises a pump base including at least one input port, a pump chamber, and a discharge leading to an output port. A rotor is retained within the chamber and is connected to a rotor shaft. The device further includes a superstructure attached to and positioned above the pump housing, a motor on the superstructure, a drive shaft connected to the motor and a coupling connecting the drive shaft to the rotor shaft. The rotor extends beyond the input port to deflect solid particles thereby reducing jams and preferably is a dual-flow rotor, directing molten metal both into the chamber and out through the discharge. The coupling is flexible and has two coupling members with a flexible disc disposed therebetween. Another aspect of the invention is a housing for a transfer pump that includes a discharge leading to an output port and a button adaptor extending from the discharge. The button is dimensioned so that it can connect to a metal transfer conduit without the use of cement thereby reducing maintenance costs and downtime. Further, the vertical members such as the support posts, metal transfer conduit and rotor shaft, may be sectional so that anti-corrosive materials may be used for the sections positioned in the most corrosive areas of the molten metal furnace. Additionally, a stationary component of the device may be configured to retain a thermocouple.

29 Claims, 20 Drawing Sheets

U.S. PATENT DOCUMENTS

| | | | | |
|---|---|---|---|---|
| 251,104 | A | | 12/1881 | Finch |
| 364,804 | A | | 6/1887 | Cole |
| 506,572 | A | | 10/1893 | Wagener |
| 585,188 | A | | 6/1897 | Davis |
| 898,499 | A | | 9/1908 | O'Donnell |
| 1,100,475 | A | | 6/1914 | Franckaerts |
| 1,331,997 | A | | 2/1920 | Neal |
| 1,454,967 | A | | 5/1923 | Gill |
| 1,518,501 | A | | 12/1924 | Gill |
| 1,522,765 | A | | 1/1925 | Wilke |
| 1,526,851 | A | | 2/1925 | Hall |
| 1,669,668 | A | | 5/1928 | Marshall |
| 1,673,594 | A | | 6/1928 | Schmidt |
| 1,717,969 | A | | 6/1929 | Goodner |
| 1,896,201 | A | | 2/1933 | Sterner-Rainer |
| 2,038,221 | A | | 4/1936 | Kagi |
| 2,280,979 | A | | 4/1942 | Rocke |
| 2,290,961 | A | | 7/1942 | Heuer |
| 2,488,447 | A | | 11/1949 | Tangen et al. |
| 2,515,478 | A | | 7/1950 | Tooley et al. |
| 2,528,210 | A | | 10/1950 | Stewart |
| 2,566,892 | A | | 9/1951 | Jacobs |
| 2,677,609 | A | | 5/1954 | Moore et al. |
| 2,698,583 | A | | 1/1955 | House et al. |
| 2,787,873 | A | | 4/1957 | Hadley |
| 2,808,782 | A | | 10/1957 | Thompson et al. |
| 2,821,472 | A | | 1/1958 | Peterson et al. |
| 2,832,292 | A | | 4/1958 | Edwards |
| 2,865,618 | A | | 12/1958 | Abell |
| 2,901,677 | A | | 8/1959 | Chessman et al. |
| 2,948,524 | A | | 8/1960 | Sweeney et al. |
| 2,978,885 | A | | 4/1961 | Davison |
| 2,984,524 | A | | 5/1961 | Franzen |
| 2,987,885 | A | | 6/1961 | Hodge |
| 3,010,402 | A | * | 11/1961 | King ..... 415/131 |
| 3,048,384 | A | | 8/1962 | Sweeney et al. |
| 3,070,393 | A | | 12/1962 | Silverberg et al. |
| 3,092,030 | A | | 6/1963 | Wunder |
| 3,227,547 | A | | 1/1966 | Szekely |
| 3,244,109 | A | | 4/1966 | Barske |
| 3,251,676 | A | | 5/1966 | Johnson |
| 3,255,702 | A | | 6/1966 | Gehrm |
| 3,272,619 | A | | 9/1966 | Sweeney et al. |
| 3,289,473 | A | | 12/1966 | Louda |
| 3,291,473 | A | | 12/1966 | Sweeney et al. |
| 3,400,923 | A | | 9/1968 | Howie et al. |
| 3,417,929 | A | | 12/1968 | Secrest |
| 3,459,133 | A | * | 8/1969 | Scheffler ..... 415/200 |
| 3,459,346 | A | | 8/1969 | Tinnes |
| 3,487,805 | A | | 1/1970 | Satterthwaite |
| 3,512,762 | A | | 5/1970 | Umbricht |
| 3,512,788 | A | | 5/1970 | Kilbane |
| 3,618,917 | A | | 11/1971 | Fredrikson |
| 3,650,730 | A | | 3/1972 | Derham et al. |
| 3,689,048 | A | | 9/1972 | Foulard et al. |
| 3,715,112 | A | | 2/1973 | Carbonnel |
| 3,743,263 | A | | 7/1973 | Szekely |
| 3,743,500 | A | | 7/1973 | Foulard et al. |
| 3,753,690 | A | | 8/1973 | Emley et al. |
| 3,759,635 | A | | 9/1973 | Carter et al. |
| 3,767,382 | A | | 10/1973 | Bruno et al. |
| 3,776,660 | A | * | 12/1973 | Anderson et al. ..... 415/200 |
| 3,785,632 | A | | 1/1974 | Kraemer et al. |
| 3,814,400 | A | | 6/1974 | Seki |
| 3,824,042 | A | | 7/1974 | Barnes et al. |
| 3,836,280 | A | | 9/1974 | Koch |
| 3,839,019 | A | | 10/1974 | Bruno et al. |
| 3,871,872 | A | | 3/1975 | Downing et al. |
| 3,873,305 | A | | 3/1975 | Claxton et al. |
| 3,886,992 | A | | 6/1975 | Maas et al. |
| 3,915,694 | A | | 10/1975 | Ando |
| 3,954,134 | A | | 5/1976 | Maas et al. |
| 3,961,778 | A | | 6/1976 | Carbonnel et al. |
| 3,972,709 | A | | 8/1976 | Chin et al. |
| 3,984,234 | A | | 10/1976 | Claxton et al. |
| 3,985,000 | A | | 10/1976 | Hartz |
| 3,997,336 | A | | 12/1976 | van Linden et al. |
| 4,003,560 | A | | 1/1977 | Carbonnel |
| 4,018,598 | A | | 4/1977 | Markus |
| 4,052,199 | A | | 10/1977 | Mangalick |
| 4,068,965 | A | | 1/1978 | Lichti |
| 4,091,970 | A | | 5/1978 | Komiyama et al. |
| 4,126,360 | A | | 11/1978 | Miller et al. |
| 4,128,415 | A | | 12/1978 | van Linden et al. |
| 4,169,584 | A | | 10/1979 | Mangalick |
| 4,286,985 | A | | 9/1981 | van Linden et al. |
| 4,322,245 | A | | 3/1982 | Claxton |
| 4,351,514 | A | | 9/1982 | Koch |
| 4,370,096 | A | | 1/1983 | Church |
| 4,372,541 | A | | 2/1983 | Bocourt et al. |
| 4,392,888 | A | | 7/1983 | Eckert et al. |
| 4,410,299 | A | | 10/1983 | Shimoyama |
| 4,456,424 | A | | 6/1984 | Araoka |
| 4,504,392 | A | | 3/1985 | Groteke |
| 4,537,624 | A | | 8/1985 | Tenhover et al. |
| 4,537,625 | A | | 8/1985 | Tenhover et al. |
| 4,556,419 | A | | 12/1985 | Otsuka et al. |
| 4,586,845 | A | | 5/1986 | Morris |
| 4,714,371 | A | | 12/1987 | Cuse |
| 4,834,573 | A | | 5/1989 | Asano et al. |
| 4,851,296 | A | | 7/1989 | Tenhover et al. |
| 4,859,413 | A | | 8/1989 | Harris et al. |
| 4,867,638 | A | | 9/1989 | Handtmann et al. |
| 4,884,786 | A | | 12/1989 | Gillespie |
| 4,898,367 | A | | 2/1990 | Cooper |
| 4,923,770 | A | | 5/1990 | Grasselli et al. |
| 4,930,986 | A | | 6/1990 | Cooper |
| 4,931,091 | A | | 6/1990 | Waite et al. |
| 4,940,214 | A | | 7/1990 | Gillespie |
| 4,940,384 | A | | 7/1990 | Amra et al. |
| 4,954,167 | A | | 9/1990 | Cooper |
| 4,973,433 | A | | 11/1990 | Gilbert et al. |
| 4,989,736 | A | | 2/1991 | Andersson et al. |
| 5,028,211 | A | | 7/1991 | Mordue et al. |
| 5,078,572 | A | | 1/1992 | Amra et al. |
| 5,088,893 | A | | 2/1992 | Gilbert et al. |
| 5,092,821 | A | | 3/1992 | Gilbert et al. |
| 5,098,134 | A | | 3/1992 | Monckton |
| 5,131,632 | A | | 7/1992 | Olson |
| 5,143,357 | A | | 9/1992 | Gilbert et al. |
| 5,145,322 | A | | 9/1992 | Senior, Jr. et al. |
| 5,152,631 | A | | 10/1992 | Bauer |
| 5,162,858 | A | | 11/1992 | Shoji et al. |
| 5,165,858 | A | | 11/1992 | Gilbert et al. |
| 5,203,681 | A | | 4/1993 | Cooper |
| 5,268,020 | A | | 12/1993 | Claxton |
| 5,286,163 | A | | 2/1994 | Amra et al. |
| 5,308,045 | A | | 5/1994 | Cooper |
| 5,310,412 | A | | 5/1994 | Gilbert et al. |
| 5,318,360 | A | | 6/1994 | Langer et al. |
| 5,330,328 | A | | 7/1994 | Cooper |
| 5,364,078 | A | | 11/1994 | Pelton |
| 5,388,633 | A | | 2/1995 | Mercer, II et al. |
| 5,399,074 | A | | 3/1995 | Nose et al. |
| 5,407,294 | A | | 4/1995 | Giannini |
| 5,431,551 | A | | 7/1995 | Aquino et al. |
| 5,454,423 | A | | 10/1995 | Tsuchida et al. |
| 5,468,280 | A | | 11/1995 | Areaux |
| 5,470,201 | A | | 11/1995 | Gilbert et al. |
| 5,484,265 | A | | 1/1996 | Horvath et al. |
| 5,495,746 | A | | 3/1996 | Sigworth |

5,509,791 A 4/1996 Turner
5,558,501 A 9/1996 Wang et al.
5,558,505 A 9/1996 Mordue et al.
5,586,863 A 12/1996 Gilbert et al.
5,597,289 A * 1/1997 Thut ..... 415/200
5,622,481 A 4/1997 Thut
5,634,770 A 6/1997 Gilbert et al.
5,655,849 A 8/1997 McEwen et al.
5,662,725 A 9/1997 Cooper
5,678,807 A 10/1997 Cooper
5,685,701 A 11/1997 Chandler et al.
5,716,195 A 2/1998 Thut
5,735,668 A 4/1998 Klein
5,735,935 A * 4/1998 Arreaux ..... 75/571
5,741,422 A 4/1998 Eichenmiller et al.
5,772,324 A * 6/1998 Falk ..... 374/140
5,785,494 A 7/1998 Vild et al.
5,842,832 A 12/1998 Thut
5,944,496 A * 8/1999 Cooper ..... 417/423.3
5,947,705 A * 9/1999 Mordue et al. ..... 417/423.15
5,993,726 A 11/1999 Huang et al.
5,993,728 A 11/1999 Vild
6,036,745 A 3/2000 Gilbert et al.
6,074,455 A 6/2000 Van Linden et al.

* cited by examiner

MOLTEN METAL PUMP WITH METAL-TRANSFER CONDUIT MOLTEN METAL PUMP

This is a continuation of patent application No. 08/759,780 filed on Dec. 3, 1996, now U.S. Pat. No. 5,944,496.

FIELD OF THE INVENTION

The present invention relates to devices for pumping molten metal. More particularly, the invention relates to a more efficient molten metal pump that includes low-maintenance, easy-to-replace components.

BACKGROUND OF THE INVENTION

Devices for pumping molten metal (referred to herein as molten metal pumps or pumping devices), particularly molten aluminum, and various components that can be used with these devices are generally disclosed in U.S. Pat. No. 2,948,524 to Sweeney et al. and U.S. Pat. No. 5,203,681 to Cooper entitled "Submersible Molten Metal Pump," the disclosures of which are incorporated herein by reference.

A problem inherent in prior art devices is costly, time-consuming maintenance. Molten metal pumping devices operate in an extremely hostile environment, usually a molten aluminum bath. The molten aluminum is maintained at a temperature of 1200–1500° F. and contains contaminants, such as magnesium, iron, dross and pieces of brick. Additionally, chlorine gas, which is highly corrosive, is usually released in the molten aluminum to react with and remove the magnesium. As a result of the high temperatures and chemical composition of the metallic bath, the bath is extremely caustic and gradually oxidizes the pumping device's components.

Another problem with molten metal pumps is related to the pressure generated by pumping the metal and the presence of solid particles within the molten metal bath. Molten metal pumps include a motor, a rotor shaft, a rotor (or impeller) and a pump base. The pump base has a chamber formed therein, an input port(s) (also called an inlet(s)) and a discharge that leads to an output port (also called an outlet). The input port and discharge are in communication with the chamber. The motor is connected to the rotor shaft and drives, or spins, the rotor shaft, connected to the rotor, which is located within the pump chamber. The molten metal enters the chamber through the input port(s) and the spinning rotor forces (i.e., pumps) the molten metal through the discharge and out of the port.

The pressure generated by pumping the molten metal can cause the rotor shaft to move eccentrically (i.e. to wobble). Further, if solid particles such as slag or brick enter the pump chamber and strike the rotor, the rotor shaft is jarred. Eccentric movements and sudden changes in speed caused by jarring can damage the rotor shaft or the coupling that joins the rotor shaft to the motor drive shaft. In order to prevent the rotor shaft from breaking, and to prevent damage to the coupling, the coupling should be flexible to allow for movement.

Further, when dross, pieces of brick or other solid particles enter the pump chamber they may wedge between the rotor and the upper wall of the pump chamber, which may cause the rotor to jam and the rotor shaft to break. One solution to this problem is described in U.S. Pat. No. 5,203,681 to Cooper entitled "Submersible Molten Metal Pump." This patent discloses a pump having a non-volute pump chamber to allow for the passage of solids. Even if this design is utilized, however, solid particles may still wedge between the upper wall of the pump chamber, or upper wear ring, and the rotor, thus jamming the rotor.

Further, molten metal pumps come in several versions, one of which is referred to as a transfer pump. A transfer pump normally has a discharge formed in the top of the pump housing. A metal-transfer conduit, or riser, extends from the discharge and out of the metallic bath where it is generally supported by a metal support structure known as a superstructure and is connected to a 90° elbow. The transfer pump pumps molten metal through the discharge and through the metal-transfer conduit and elbow where it exits into another metallic bath chamber (i.e., the molten metal is transferred to another chamber). Until now, the metal transfer conduit has been cemented to the discharge opening and to the steel superstructure. Although cementing the conduit generally works well, it is extremely difficult to replace a metal-transfer conduit so connected because: 1) the pump must be removed from the metallic bath and cooled, 2) the cement must be chiseled away, 3) the new conduit must be assembled and cemented to the discharge, 4) the conduit must be cemented to the steel supporting structure, and 5) the new cement must be cured to remove moisture, a process that, by itself, normally takes approximately twenty four hours. The entire replacement operation can take up to two days.

SUMMARY OF THE INVENTION

The present invention solves these and other problems by providing a molten metal pumping device comprising a molten metal pump including a rotor sized to fit within the pump chamber and to extend beyond the pump input port. As the rotor spins, the portion extending beyond the input port deflects many solid particles rather than allowing them to enter the pump chamber. This reduces the likelihood of jams occurring. Optionally, the rotor can be a dual-flow device. One embodiment of a dual-flow rotor of the present invention has substantially vertically-oriented vane(s) that have a top portion angled towards the horizontal axis. As the rotor spins, the angled top portion(s) direct the molten metal down into the pump chamber and the vertically-oriented portion(s) direct the molten metal outward against the wall of the pump chamber, where the metal is eventually directed out of the discharge.

The pumping device of the present invention also includes a novel coupling for connecting the rotor shaft to the motor drive shaft wherein the coupling comprises a first coupling member and a second coupling member with a flexible disk disposed therebetween. The first coupling member connects to the motor drive shaft and the second coupling member connects to the rotor shaft. If the rotor shaft moves eccentrically or is jarred, the flexible disk absorbs the movement, whether it be side-to-side or up-and-down, or a combination of both, in a full 360° range, thus preventing the rotor shaft from breaking and preventing damage to the coupling or to the motor shaft. Furthermore, the coupling's performance relies solely on the flexibility of the disk; it does not require lubricants to maintain its flexibility. Additionally, the coupling is not connected to either the motor drive shaft or rotor drive shaft by a threaded connection. It drives the rotor shaft by transferring force through coupling surfaces that mate with surfaces of the rotor shaft, which is described in greater detail herein.

The present invention also includes a pumping device comprising a transfer pump having a metal-transfer conduit that is not cemented or similarly affixed to the pump base or the steel superstructure. Preferably, the metal-transfer conduit has a first end configured to either rest on a button attached to the pump output port or to fit into an angled bore formed in the discharge. The metal-transfer conduit also has a second end opposite the first end that is supported by a two-piece coupling that engages the conduit without the use of cement or other sealant. With the noncemented structure of the present invention, it takes only a few hours to replace the metal-transfer conduit.

Further, any vertical member, such as the metal-transfer conduit, support posts or shaft, of the present invention can be provided as a plurality of connectable sections so that the section in contact with the extremely corrosive surface of the metallic bath may be individually replaced or be formed of highly corrosion-resistant material, such as ceramic; whereas the rest of the conduit may be formed of less expensive material, such as graphite. This structure also allows for the replacement of an individual worn section of a vertical member, instead of having to replace the entire member.

It is therefore an object of the present invention to provide a pumping device that increases pumping efficiency.

It is a further object of the present invention is to provide a device that includes a dual-flow rotor.

It is a further object of the present invention to reduce jamming that occurs in molten metal pumping devices.

It is a further object of the present invention to provide a pumping device that reduces maintenance downtime.

It is a further object of the present invention to provide a pumping device including a rotor shaft coupling that allows for eccentric movement and that does not require lubrication.

It is a further object of the present invention to provide a pumping device including a rotor shaft coupling that has no threads.

It is a further object of the present invention to provide a transfer pump including a metal-transfer conduit that is not cemented to the pump base.

It is a further object of the invention to provide a transfer pump as defined above wherein the metal-transfer conduit is supported by a pump superstructure without the use of cement.

It is a further object of the present invention to provide sectional vertical members including a sectional rotor drive shaft, sectional support posts and a sectional metal-transfer conduit wherein the sections can be connected with or without the use of cement or other sealants.

It is a further object of the present invention to provide a furnace thermocouple integral with the pump.

These and other objects will become apparent to those skilled in the art upon reading the following description and appended claims.

DETAILED DESCRIPTION OF A PREFERRED EMBODIMENT

Figure 1:
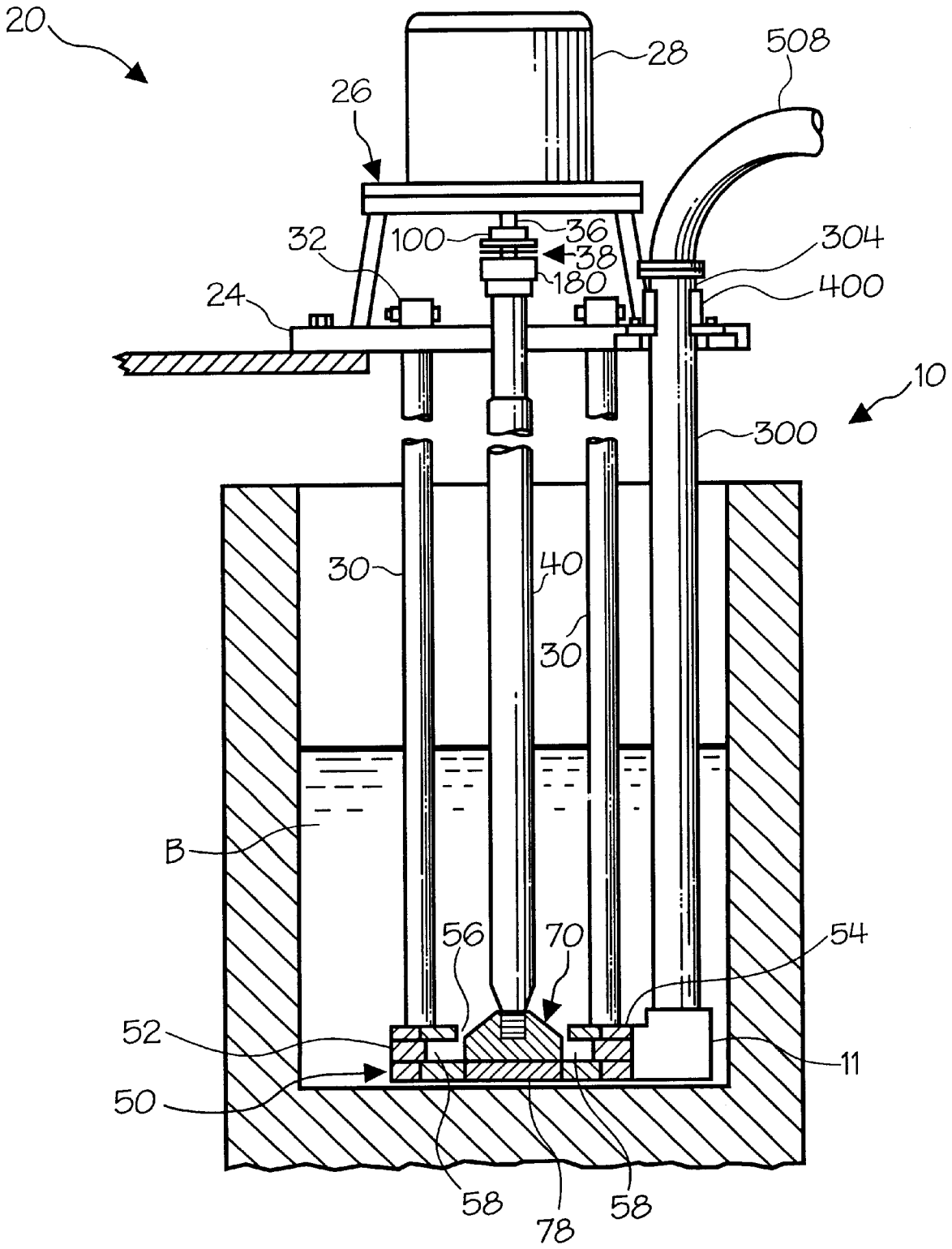
FIG. 1 is a front, partial-sectional view of a molten metal pump in accordance with the invention having a pump discharge formed in the side of the pump housing.

Referring now to the figures, where the purpose is for describing a preferred embodiment of the invention and not for limiting same, FIG. 1 shows a pumping device 10 submerged in a metallic bath B. Device 10 has a superstructure 20 and a base 50. Superstructure 20 is positioned outside of bath B when device 10 is operating and generally comprises a mounting plate 24 that supports a motor mount 26. A motor 28 is mounted to mount 26. Motor 28 is preferably electric or pneumatic although, as used herein, the term motor refers to any device capable of driving a rotor 70.

Superstructure 20 is connected to base 50 by one or more support posts 30. Preferably posts 30 extend through openings (not shown) in plate 24 and are secured by post clamps 32, which are preferably bolted to the top surface (preferred) or lower surface of plate 24.

A motor drive shaft 36 extends from motor 28. A coupling 38 has a first coupling member 100, attached to drive shaft 36, and a second coupling member 180, attached to a rotor shaft 40. Motor drive shaft 36 drives coupling 38 which, in turn, drives rotor shaft 40. Preferably neither coupling 38 nor shaft 40 have any connecting threads.

Figure 1A:
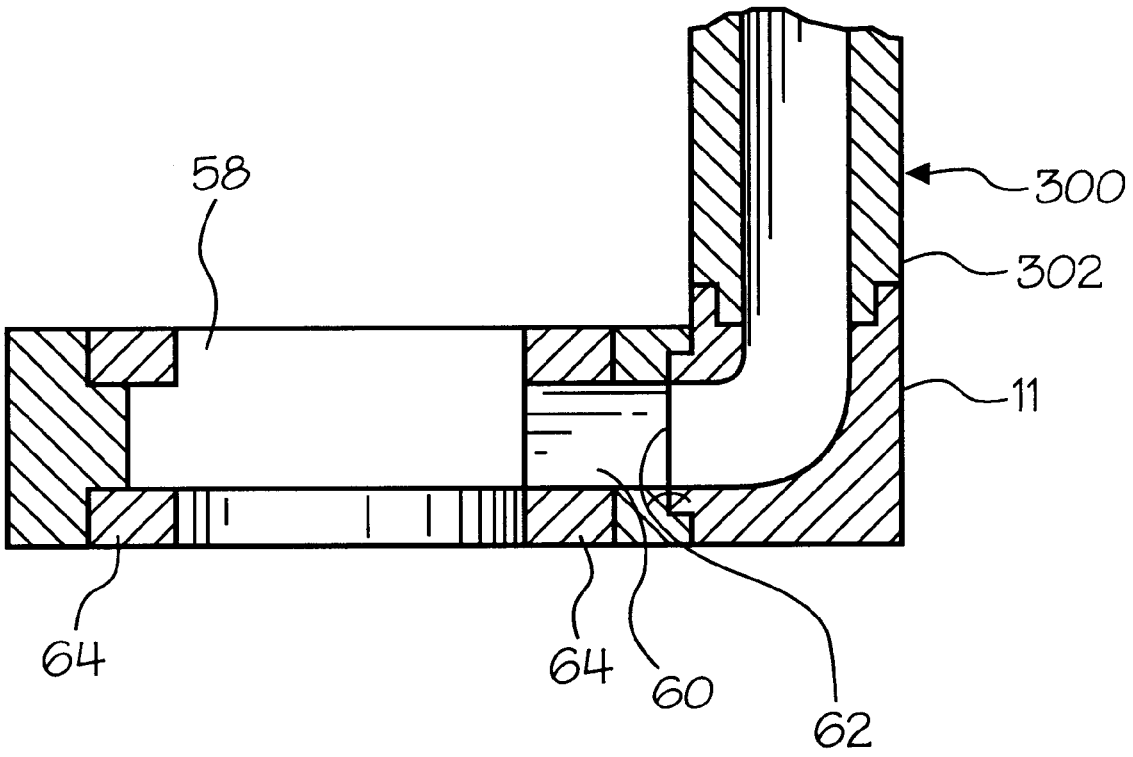
FIG. 1*a* is an enlarged, sectional front view of the pump chamber shown in FIG. 1 having a 90° elbow attached to the output port and a transfer conduit attached to the elbow.

Base 50 is preferably formed from graphite or other suitable material. Base 50 includes a top surface 54 and an input port 56, preferably formed in top surface 54. A pump chamber 58, which is in communication with port 56, is a cavity formed within housing 50. A discharge 60, shown in FIG. 1*a*, is preferably formed tangentially with, and is in fluid communication with, pump chamber 58. Discharge 60 leads to an output port 62, shown in FIG. 1*a* as being formed in a side surface of housing 50. A wear ring or bearing ring 64 is preferably made of ceramic and is cemented to the lower edge of chamber 58. Optionally, device 10 may incorporate a metal-transfer conduit, or riser, 300 connected to output port 62. Conduit 300 is preferably used in conjunction with an elbow 508 to transfer the pumped molten metal into another molten metal bath.

Figure 6:
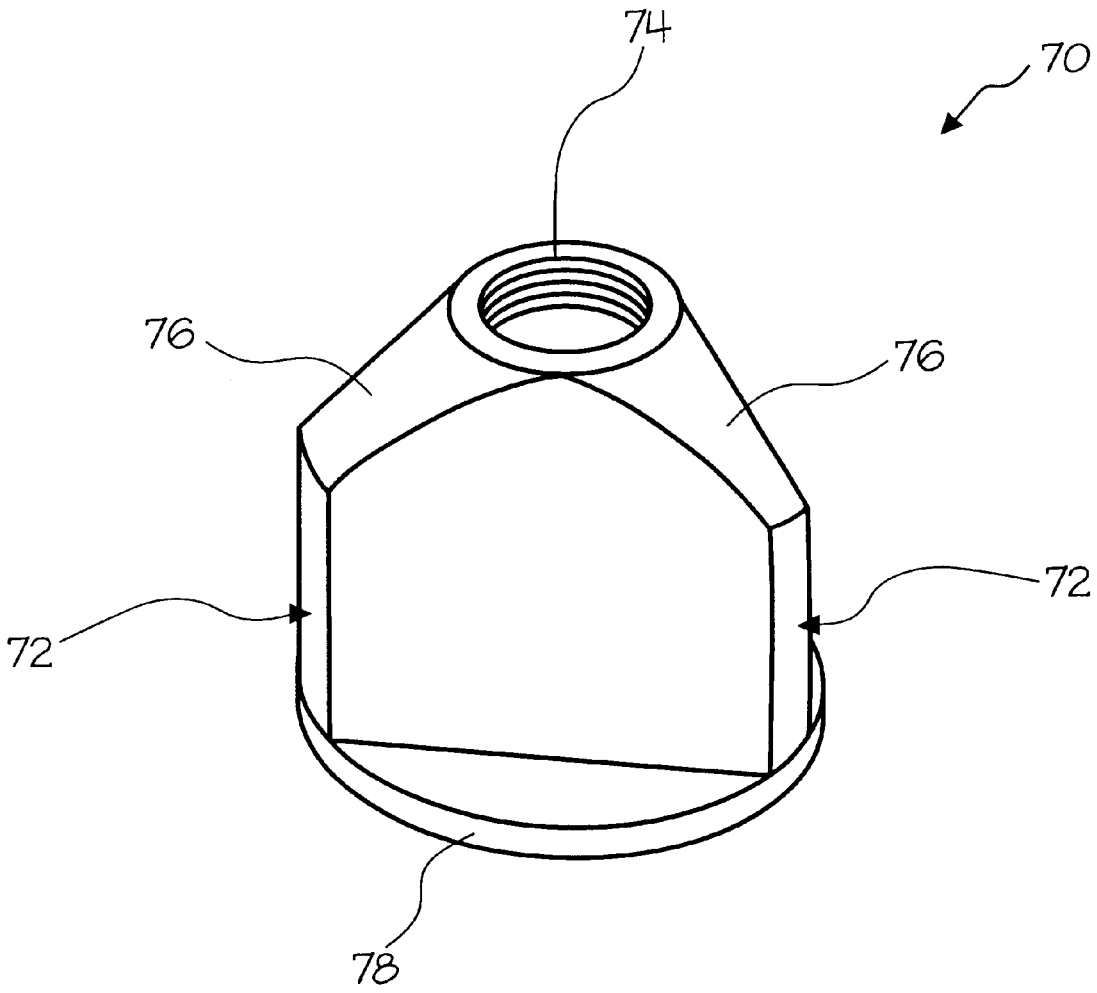
FIG. 6 is a perspective view of a rotor in accordance with the present invention.
Figure 7:
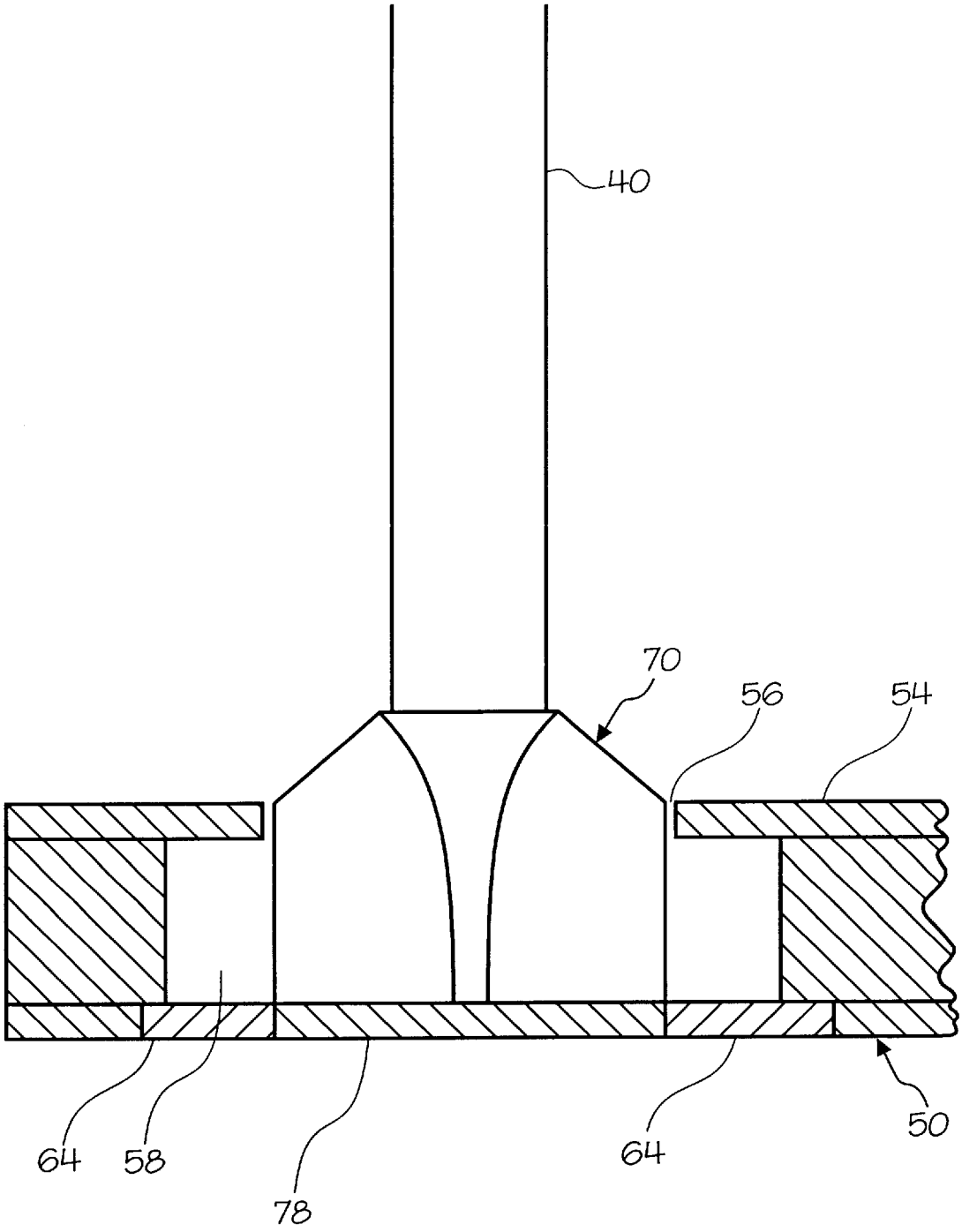
FIG. 7 is a side, cross-sectional view showing the rotor of FIG. 6 positioned in a pump chamber.

The rotors of the present invention may be used with any type of molten metal pump; they are not limited to use in transfer pumps. As shown in FIG. 1, rotor 70 is attached to and driven by shaft 40. Rotor 70 is preferably placed centrally within chamber 58. Referring to FIGS. 6–7, rotor 70 is preferably triangular (or trilobal) having three vertically-oriented vanes 72, and is imperforate, being formed of solid graphite. Rotor 70 may, however, have a perforate structure, such as impellers referred to in the art as bird cage impellers, have any number of vanes, and be of any shape, and formed of any material, so long as it extends beyond input port 56 of base 50 when device 10 is in operation. As it will be understood, should input port 56 be formed in a surface other than top surface 54 of base 50, rotor 70 would still extend beyond input port 56, so that it can deflect solid particles and prevent them from entering the input port.

Rotor 70 further includes a connective portion 74, which is preferably a threaded bore, but can be any structure capable of drivingly engaging rotor shaft 40. Angled shoulders 76 are formed as part of vanes 72. A flow blocking plate 78 is preferably formed of ceramic and is cemented to the base of rotor 70. Plate 78 rides against bearing ring 64 and blocks molten metal from entering or exiting through the bottom of chamber 58. (Alternatively, plate 78 could be replaced by a plurality of individual bearing points, or the bearing ring could be eliminated, in which case there would be openings between the tips and wear ring 64 that would function as a second input port.)

Figure 8:
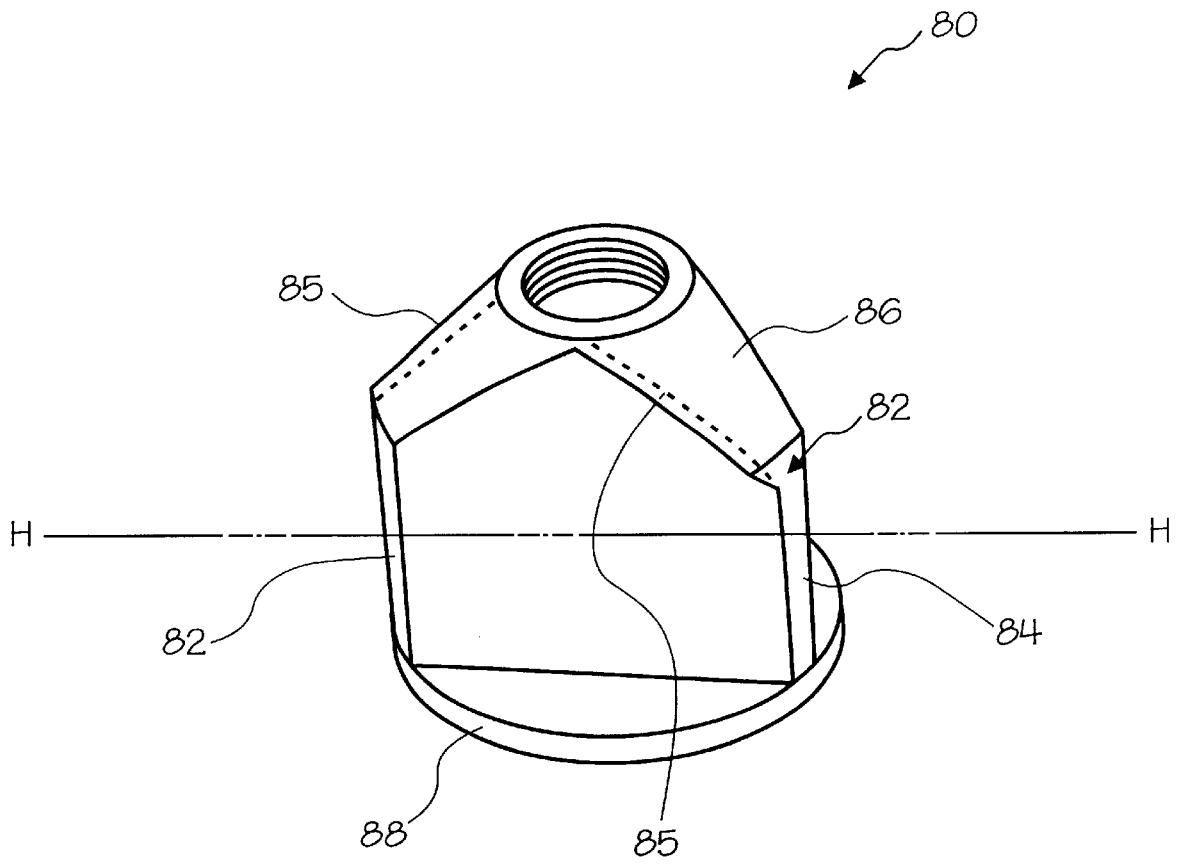
FIG. 8 is a perspective view of a dual-flow rotor in accordance with the invention.
Figure 9A:
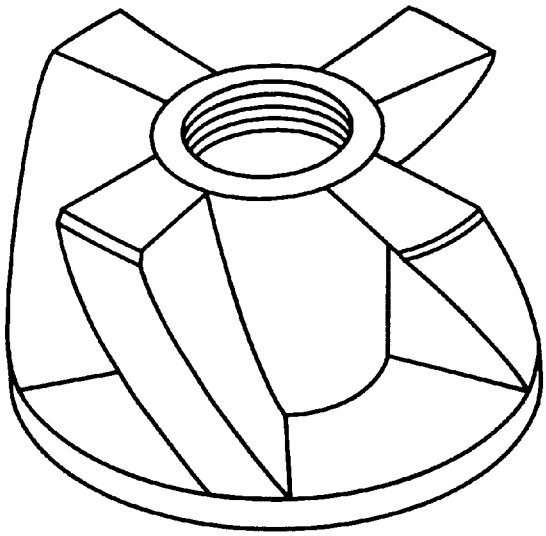
FIGS. 9*a*–9*d* are perspective views of alternative dual-flow rotors in accordance with the invention.
Figure 9B:
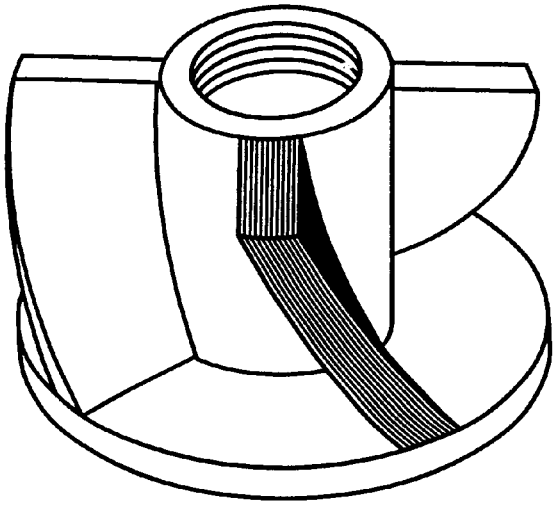
Figure 9C:
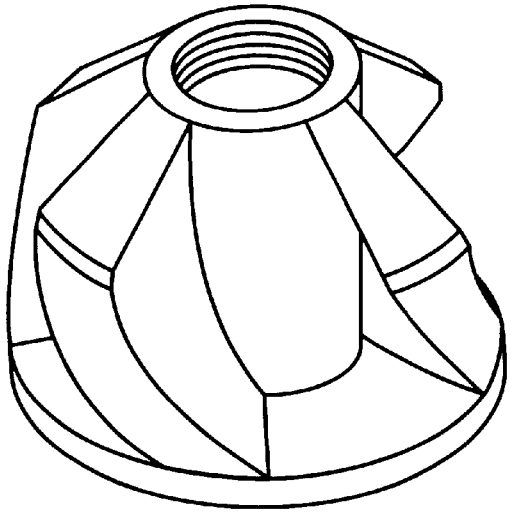
Figure 9D:
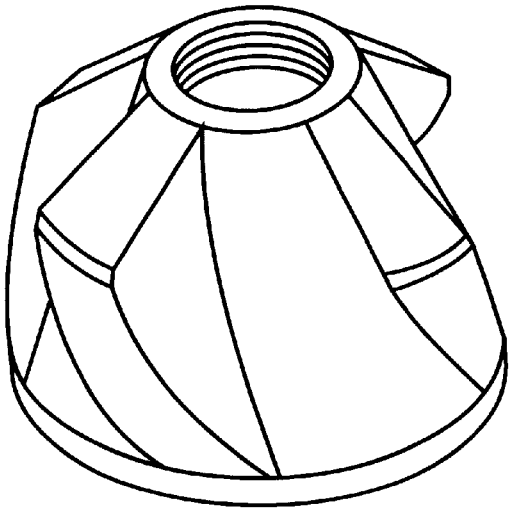

Preferred dual-flow rotor 80 is shown in FIG. 8. Rotor 80 has the same overall design as previously-described rotor 70 except that vanes 82 each include a vertically-oriented portion 84 and a portion 85 at the top 86 of at least one vane 82 that is angled towards the horizontal axis H. The respective vertical and horizonal orientation of the portions described herein is in reference to a rotor positioned in a standard pump having an input port in its top surface. The invention, however, covers any rotor having one or more vanes, wherein at least one vane includes a portion that forces molten metal into the pump chamber and at least one vane includes a portion that pushes the molten metal out of the pump chamber through the pump discharge.

Alternative dual-flow rotor designs are shown in FIGS. 9*a*–9*d*. The dual-flow rotor of the present device preferably extends beyond the pump inlet, but need not do so.

Figure 10:
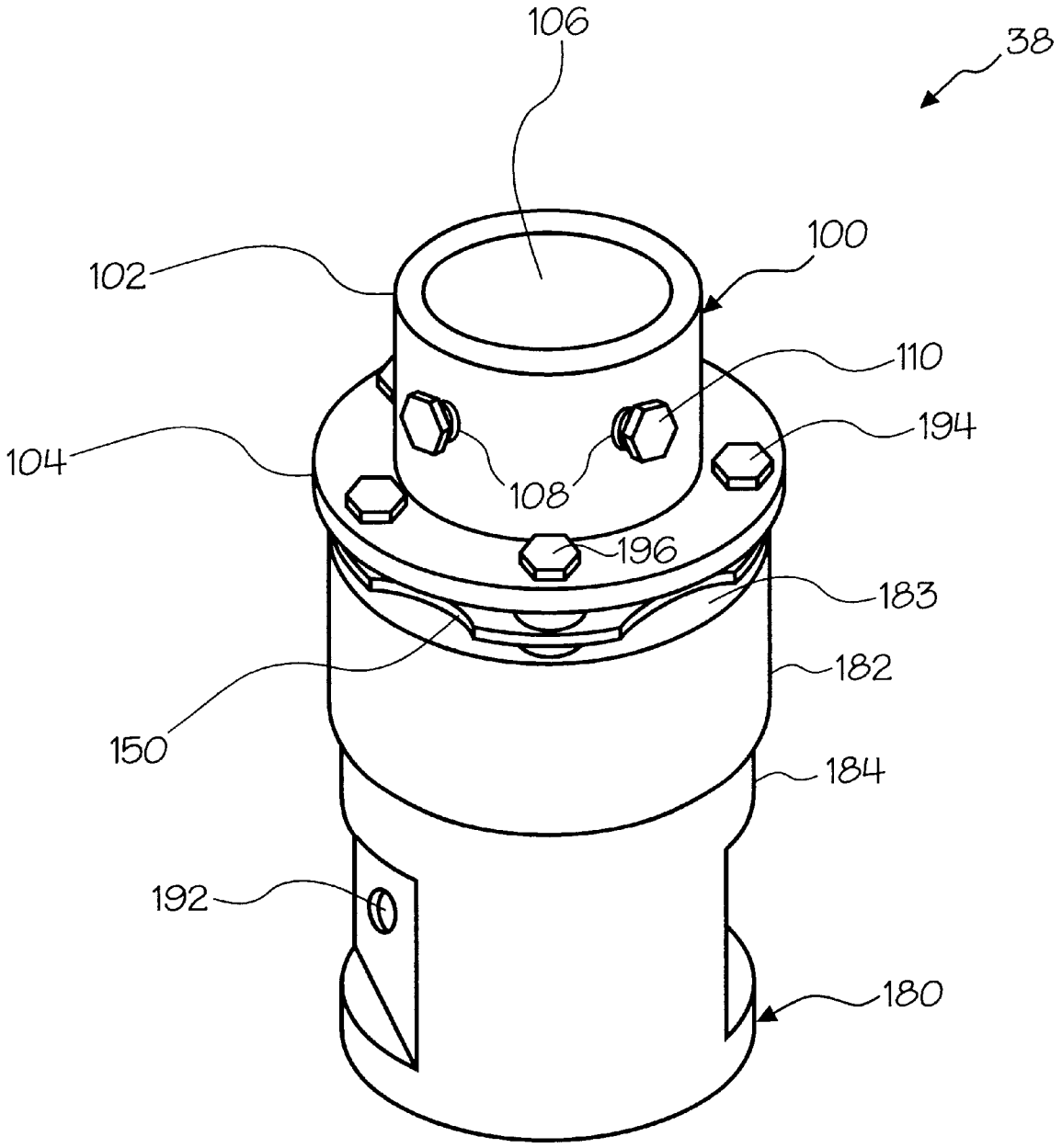
FIG. 10 is a perspective view of a shaft coupling in accordance with the present invention.
Figure 10A:
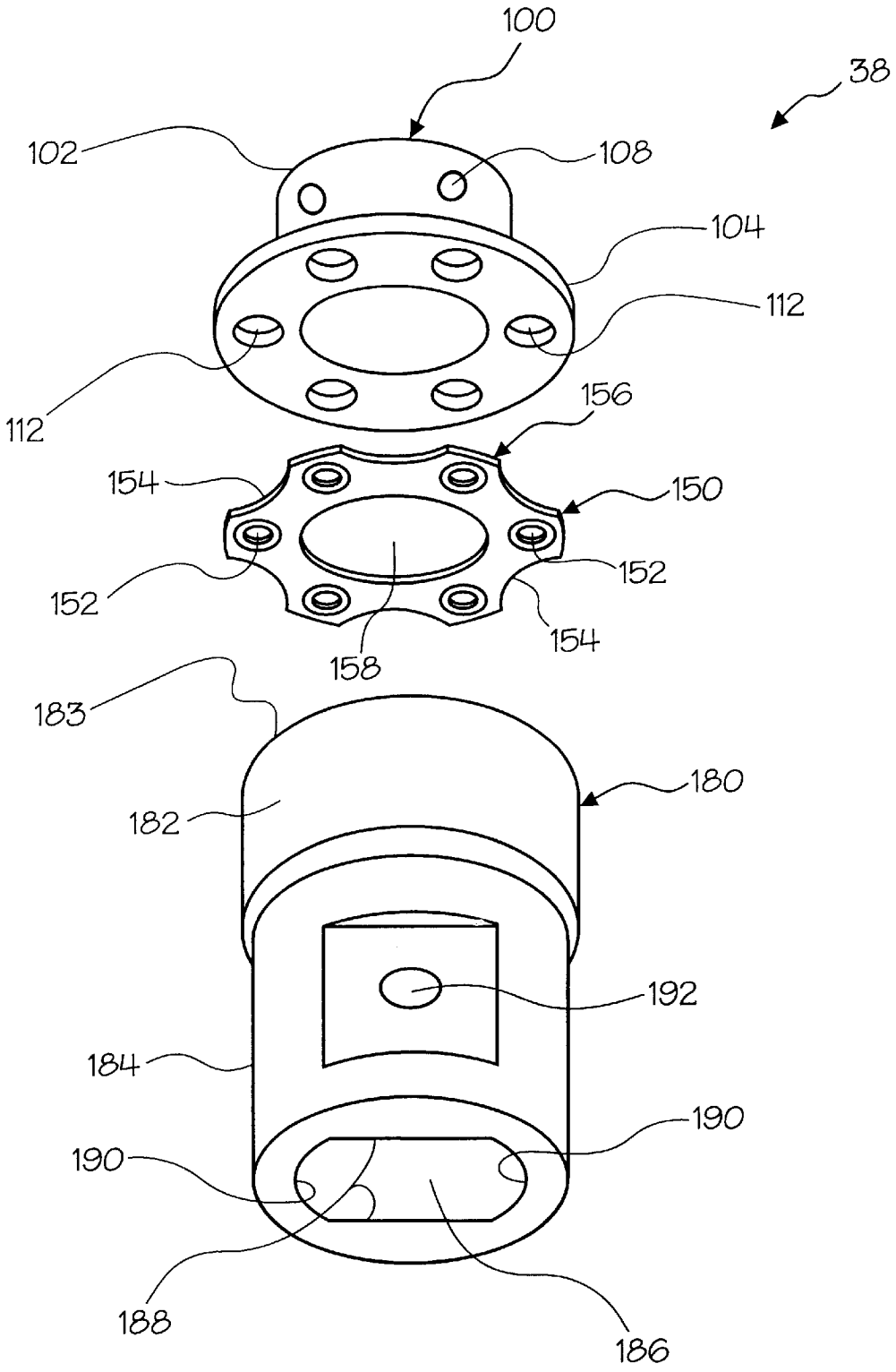
FIG. 10*a* is an exploded, perspective view of the coupling shown in FIG. 4.

As best shown in FIGS. 10 and 10*a*, coupling 38 generally comprises a first coupling member 100, a disk 150 and a second coupling member 180. First coupling member 100 is preferably formed of metal, and most preferably steel, and comprises a collar 102 and an annular flange 104. Collar 102 has an opening 106 dimensioned to receive the free end (not shown) of motor drive shaft 36. Collar 102 has threaded apertures 108 (preferably three) radially spaced about its periphery. Apertures 108 threadingly receive bolts 110 when shaft 36 is received in opening 106, and bolts 110 are tightened against the outer surface of shaft 36 to secure collar 102 and, hence, coupling member 100 to shaft 36. Alternatively, connective means other than collar 102 having bolts 110 may be utilized. Flange 104 is preferably integrally formed with collar 102 and includes apertures 112, which are radially spaced thereabout.

Disk 150 is preferably a multiple laminate comprised of pieces of thin, flexible metal (preferably steel) although other materials may be used. Disk 150 has radially spaced apertures 152, arcuate recesses 154 formed about a periphery 156 and a circular opening 158 formed centrally therein.

Second coupling member 180 is designed to receive and drive rotor shaft 40. Member 180 is preferably formed of metal such as steel or aluminum although other materials may be used. Coupling member 180 preferably includes a connective portion 182 and a drive portion 184. Connective portion 182 preferably includes three radially-spaced, threaded bores (not shown) and three radially-spaced dimples (not shown) on an upper surface 183. The bores and dimples are sized and spaced so that they can align with apertures 112 and 152. In the preferred embodiment, the threaded bores and dimples on surface 183 alternate.

Drive portion 184 includes a socket 186, which preferably has two opposing flat surfaces 188 and two opposing annular surfaces 190 so that it can receive and drive a rotor shaft 40 having a first end (not shown) configured to be received in and driven by socket 186 without the use of cement or a threaded connection. Socket 186 includes aligned, apertures 192, that will align with a cross-axial bore (not shown) formed in rotor shaft 40. When rotor shaft 40 is received in socket 186, a bolt (not shown) or pin and clip (not shown) is passed through one aperture 192, through the cross-axial bore in shaft 40 and out of the second aperture 192. If a bolt is used, a nut (not shown) is then threaded onto the end of the bolt to fasten it. This connection is used to vertically align shaft 40 and hence rotor 70 in pump chamber 58, and preferably is not used to help drive shaft 40. In the embodiment shown, a bolt (or pin) does not drive the shaft.

When assembled, first coupling member 100 is placed on disk 150 and aligned so that apertures 112 align with apertures 152. Short bolts 194 are then passed through three apertures 112, through the corresponding apertures 152 and a nut (not shown) is applied to the threaded portion so as to tighten disk 150 against first coupling member 100. Disk 150 is then placed on surface 183 so that the nuts on bolts 194 are received within the dimples. Long bolts 196 are then passed through the remaining three apertures 112, through apertures 152 and are threadingly received in the threades bores in surface 183 to connect members 100, 180 and disk 150 so that they form a single coupling 38.

As shown in FIGS. 1, 1*a*, 2, 11 and 12, pumping device 10 may be a transfer pump, in which case it will either include transfer pump base 50, or base 50' or base 50", although other base configurations could be used. As previously described, and as shown in FIG. 1, base 50 includes an upper surface 54 and a discharge 60 leading to an output port 62, which is formed in a side of base 50 (as used herein, the term discharge refers to the passageway leading from the pump chamber to the output port, and the output port is the actual opening in the exterior surface of the pump base). An extension piece 11 is attached to output port 62 and defines a passageway formed as an elbow so as to direct the flow of the pumped molten metal upward. A metal-transfer conduit 300 is connected to extension member 11 and, if secured in the manner known in the art, is cemented thereto. (Such an arrangement is generally described in U.S. Pat. No. 5,203,681 to Cooper).

Figure 2:
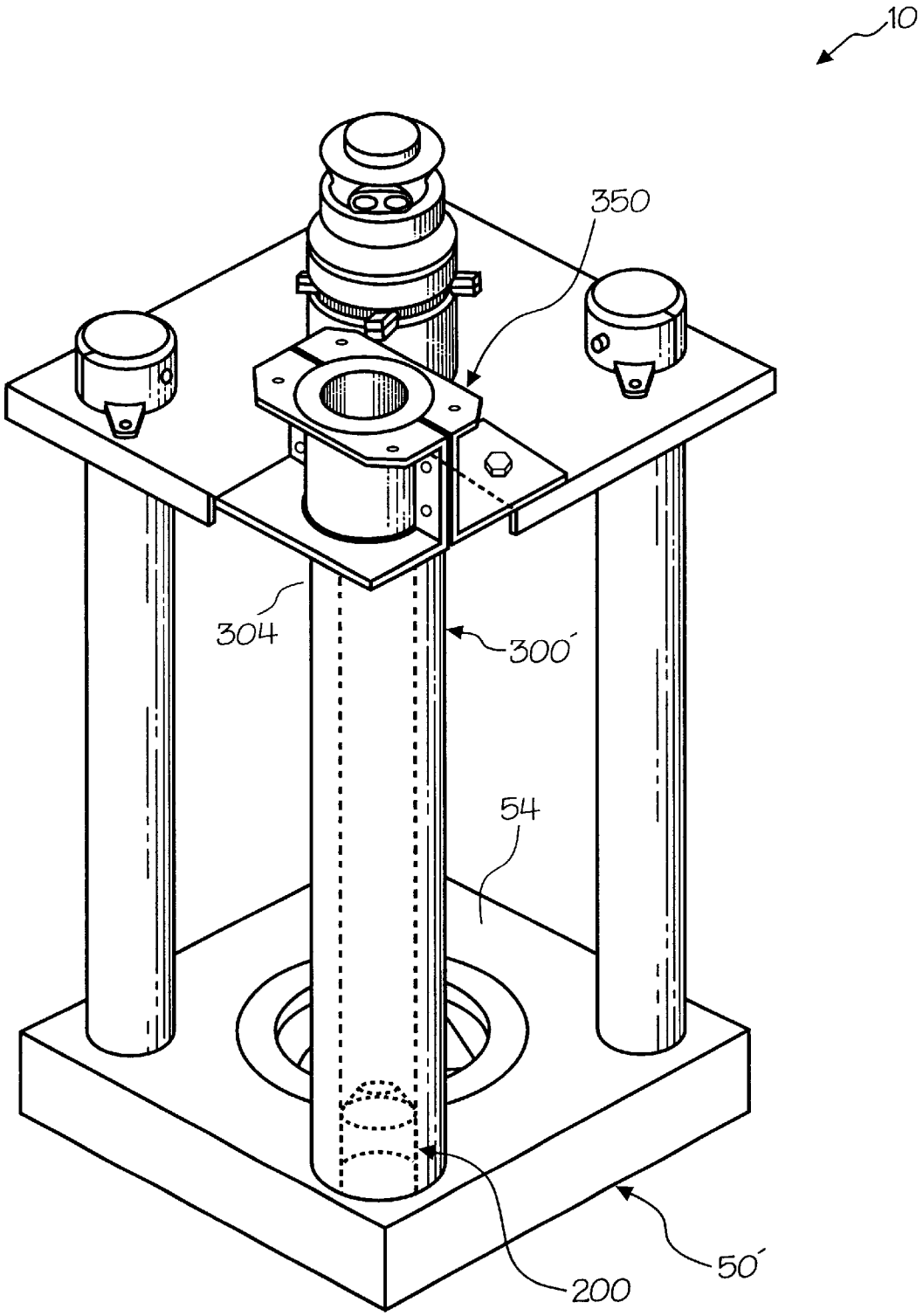
FIG. 2 is a front perspective view of a pump in accordance with the present invention having a discharge and output port formed in the top surface of the pump housing and a transfer conduit having one end attached to the output port and one end secured to the superstructure.
Figure 3:
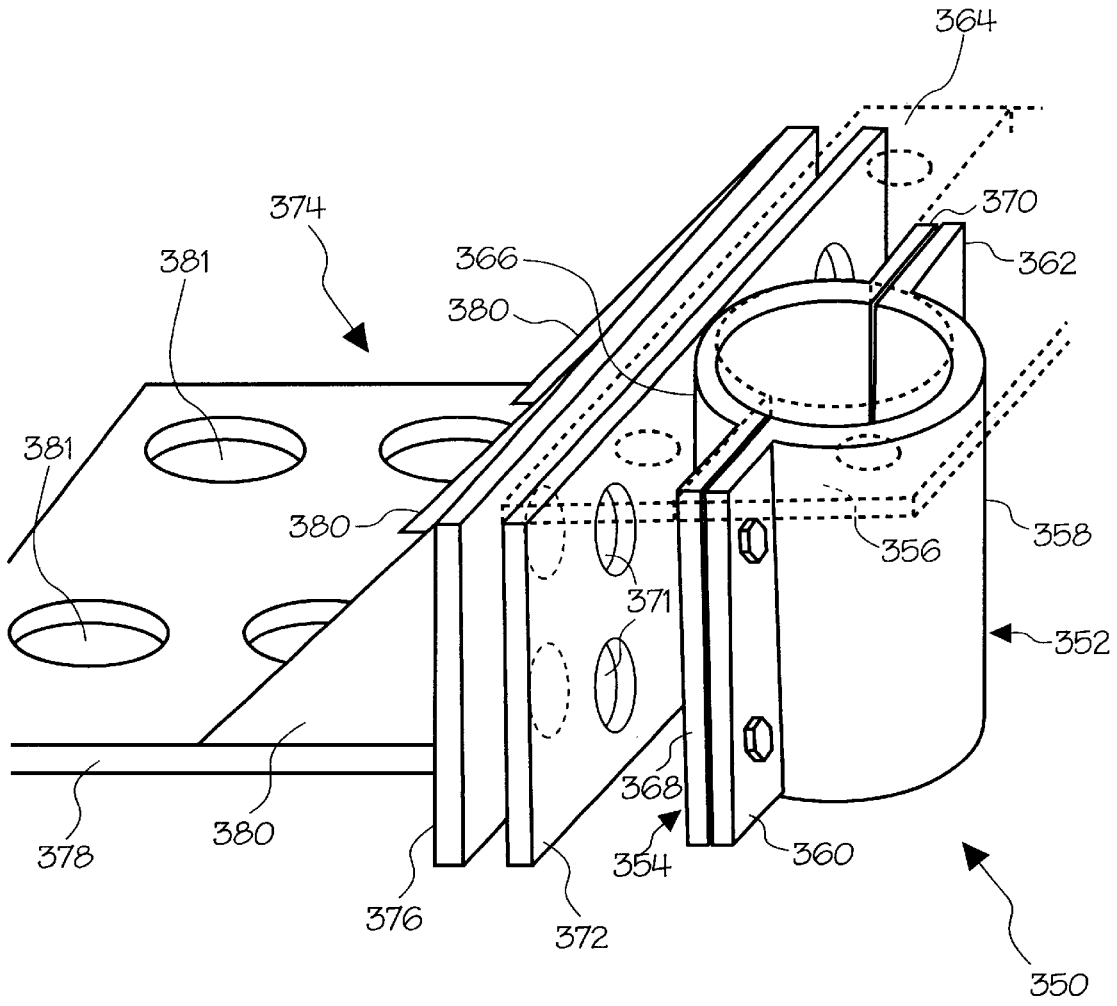
FIG. 3 is an enlarged perspective view of a clamp used to secure the metal-transfer conduit to the pump superstructure without the use of cement.
Figure 11:
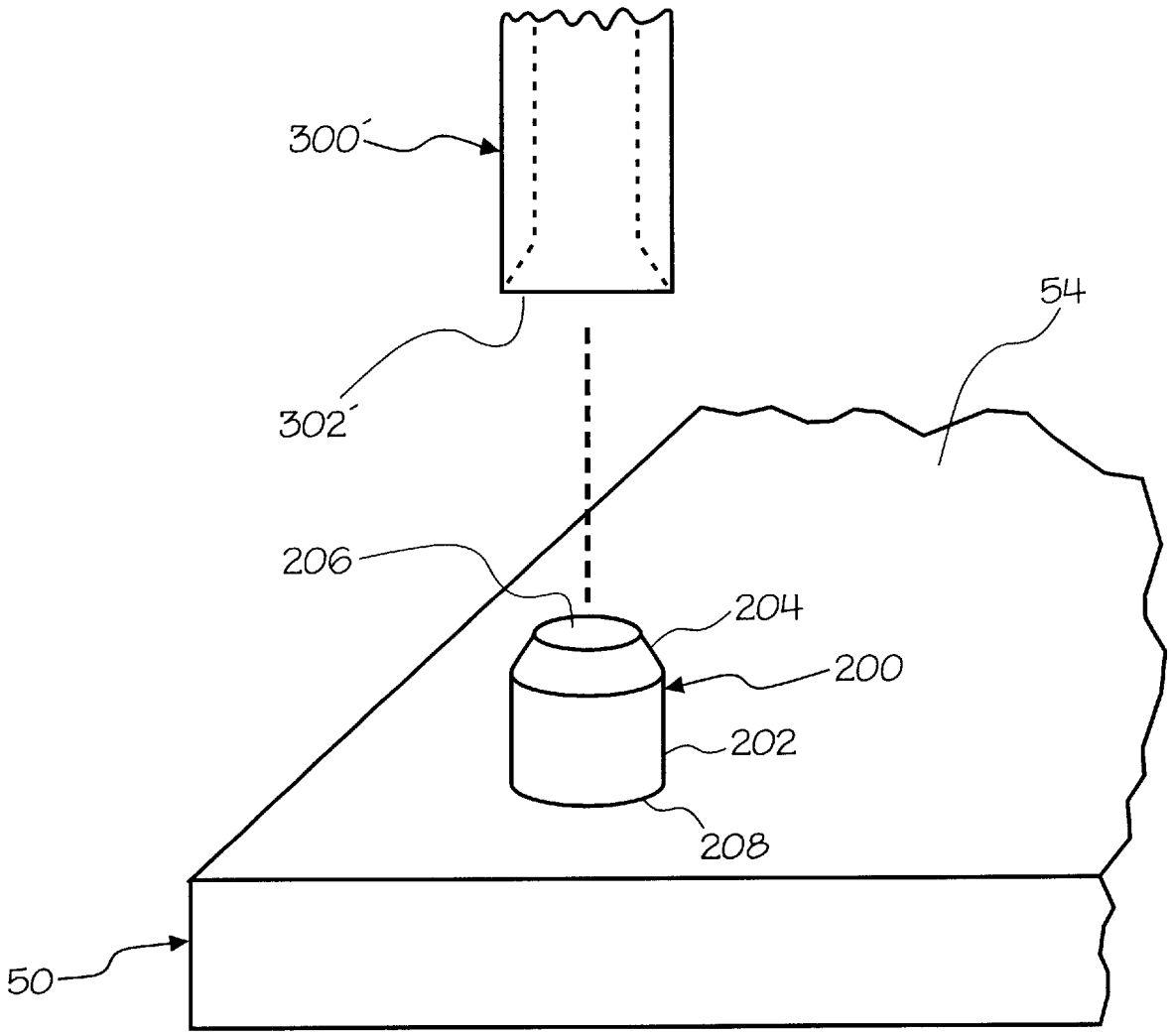
FIG. 11 is a partial, rear perspective view of a transfer pump base having a button attached to the pump outlet port.

As shown in FIGS. 2 and 11, a base 50' may include a button 200 that is preferably attached to, or integrally formed with, base 50'. As shown, button 200 has a cylindrical base 202 and a tapered portion 204. A preferably cylindrical passage 206 is defined within button 200. Cylindrical base 202 has a bottom edge 208 that rests on, and is preferably cemented to, upper surface 54, where it preferably surrounds output port 62 so that output port 62 and passage 206 communicate with one another.

Figure 15:
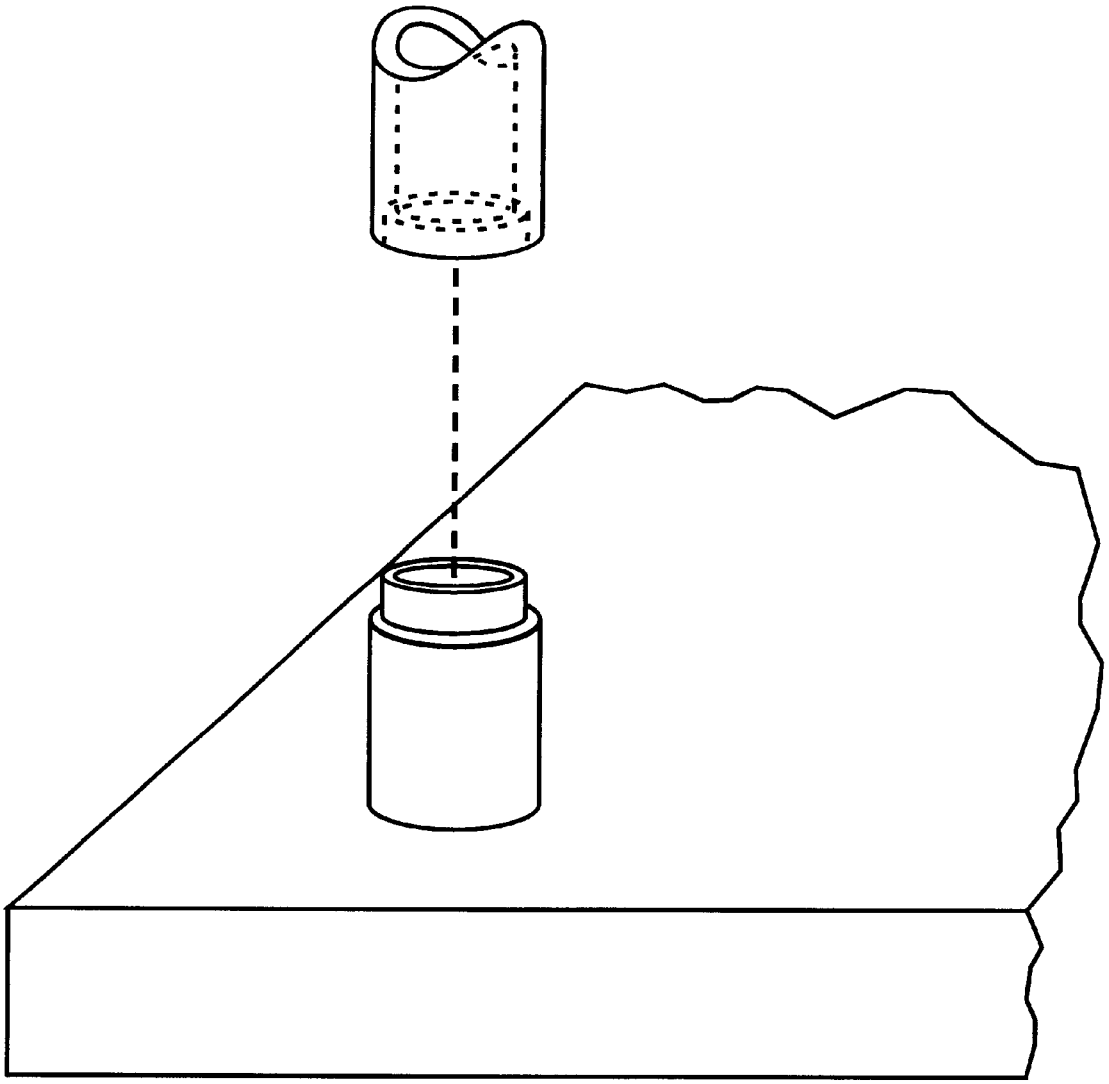
FIG. 15 shows a pump base having a stepped surface that makes a substantially-tight connection with a riser tube having a stepped end.

A metal-transfer conduit, or riser, 300' is used in conjunction with base 50'. Conduit 300' is preferably cylindrical and has a first end 302' that is internally dimensioned to receive tapered portion 204 of button 200 to create a substantially tight connection without the use of cement or other sealant. As used herein, the term substantially tight connection means that when molten metal is pumped through output port 62' and through button 200 into metal-transfer conduit 300', i.e., there may be only a minimal amount of leakage. (Alternatively, the connection between the button and the riser may be stepped as illustrated in FIG. 15, and other substantially tight connections may also be used). Button 200 may be of any size and shape as long as it allows for a substantially tight connection between it and conduit 300'. Additionally, a high temperature fiber gasket material, such material being known to those skilled in the art, can be used to help seal between the button and the metal-transfer conduit.

Figure 12:
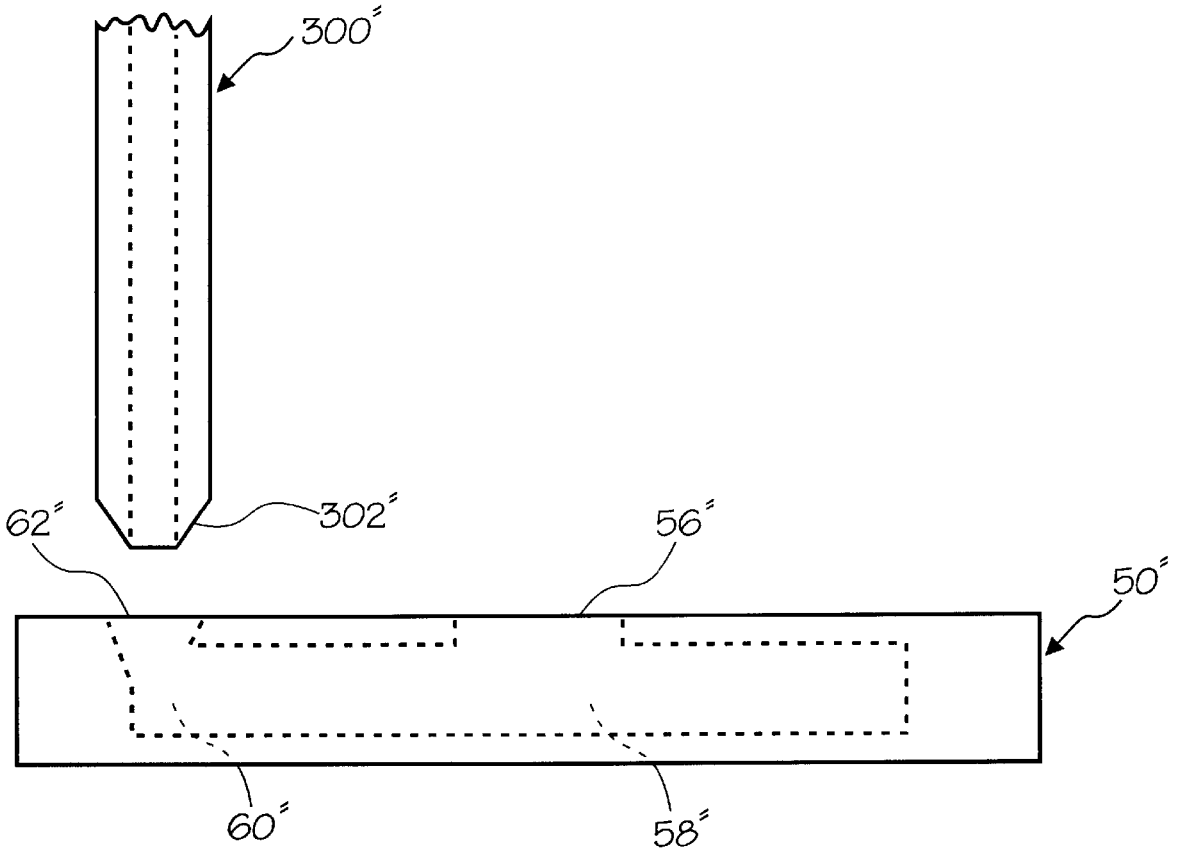
FIG. 12 is a front cross-sectional view of an alternative transfer pump base including a mating metal-transfer conduit in accordance with the invention.

In another aspect of the invention generally shown in FIG. 12, a base 50" is shown which has the same configuration as base 50' except for output port 62", which is tapered or otherwise dimensioned to receive end 302" of conduit 300" to form a substantially tight connection. The object of the invention is thus satisfied when the metal-transfer conduit forms a substantially tight metal-transfer connection with the output port without the use of cement or other sealant although, as mentioned previously, a high-temperature gasket may be used.

Figure 4:
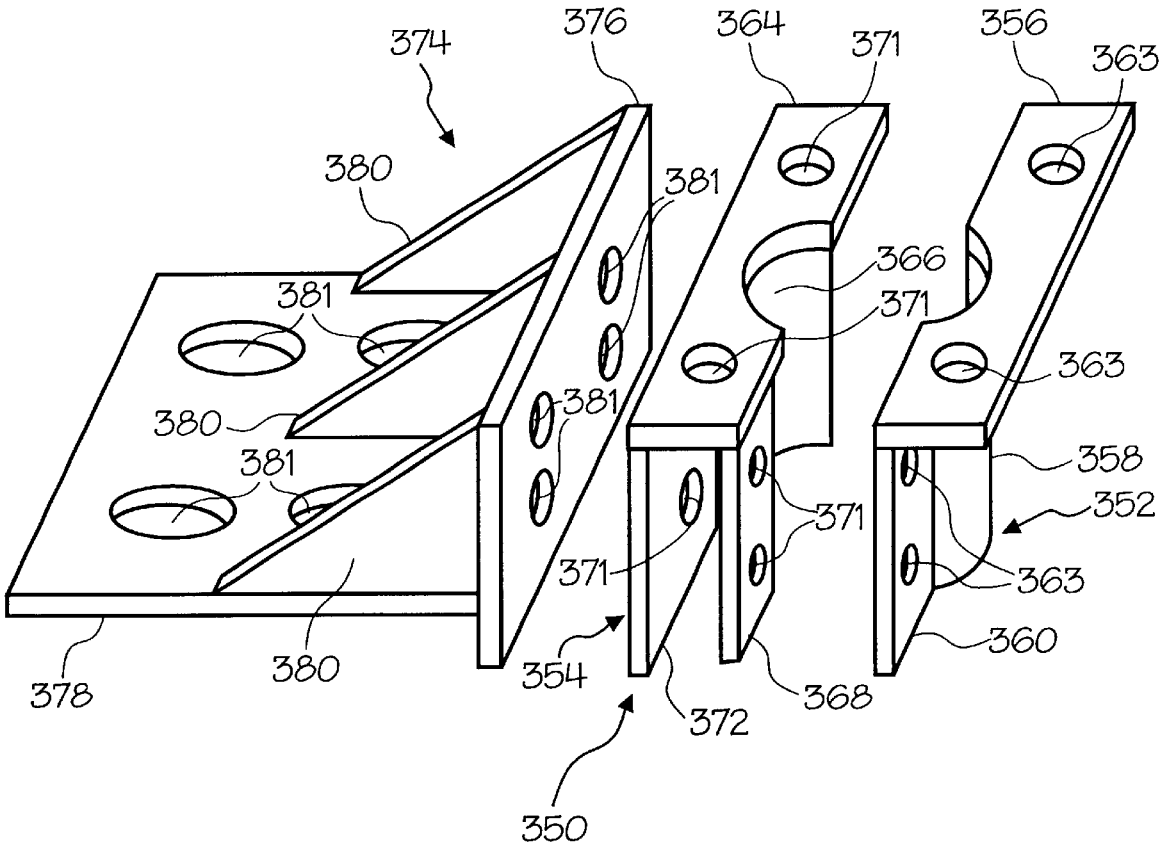
FIG. 4 is an exploded view of the clamp shown in FIG. 3.

As shown in FIG. 2 conduit 300' has a second end 304 that is supported by superstructure 20, preferably by being clamped by an adaptor 350. Adaptor 350, shown in FIG. 4, is preferably a two-piece clamp that tightens around end 304 of conduit 300 and supports it without the use of cement or other sealant. In one embodiment, adaptor 350 has a first portion 352 and a second portion 354. First portion 352 has an upper flange 356, a curved, semi-cylindrical section 358 and two lower flanges 360, 362, respectively, on either side of section 358. Apertures 363 are provided in flanges 356, 360 and 362.

Second portion 354 includes an upper flange 364, a curved, semi-cylindrical section 366 and two lower flanges 368, 370. Apertures 371 are provided in flanges 364, 368 and 370. A mounting plate 372 is connected to upper flange 364, preferably by welding.

A mounting brace 374 has a vertical flange 376, a horizontal flange 378 and support ribs 380. Mounting brace 374 is connected to superstructure 20 by positioning it on superstructure 20 so that the apertures 381 in horizontal flange 378 align with apertures (not shown) in superstructure 20, and bolting brace 374 to superstructure 20. The mounting brace 374 could so be welded to or be an integral part of superstructure, 20.

Once brace 374 is secured to superstructure 20, portion 354 is seemed to brace 374 by aligning apertures 371 in place 372 with apertures 381 in vertical flange 376, and bolts are passed through the aligned apertures so as to secure portion 354 to brace 374. The second end of a riser, such as second end 304 of riser 300', is then place against semi-cylindrical section 366. First portion 352 is then connected to second portion 354 by pressing flanges 360 and 368, and flanges 362 and 370, together. The apertures in the respective pairs of mated flanges are aligned and bolts are passed therethrough to connect portion 352 to portion 354 when first portion 352 and second portion 354 are connected, second end 304' is pressure fit within semi-cylindrical sections 366 and 358, and is thus secured without the use of cement and other sealant. Adaptor 350' is also the preferred clamping mechanism when conduits 300' or 300" are used. The combination of adaptor 350 to provide for sealant-free connection at the end of the metal-transfer conduit supported by the superstructure and sealant-free connection between the output port 62' or 62" and first end 302' or 302", respectively, allows for simple, quick removal and replacement of conduit 300' or 300". Adaptor 350 may include a protrusion or projection or other structure that mates with a corresponding structure on the riser so as to vertically locate the riser with respect to the pump base and for superstructure an embodiment of a clamp in accordance with the invention is shown in FIG. 5.

Figure 5:
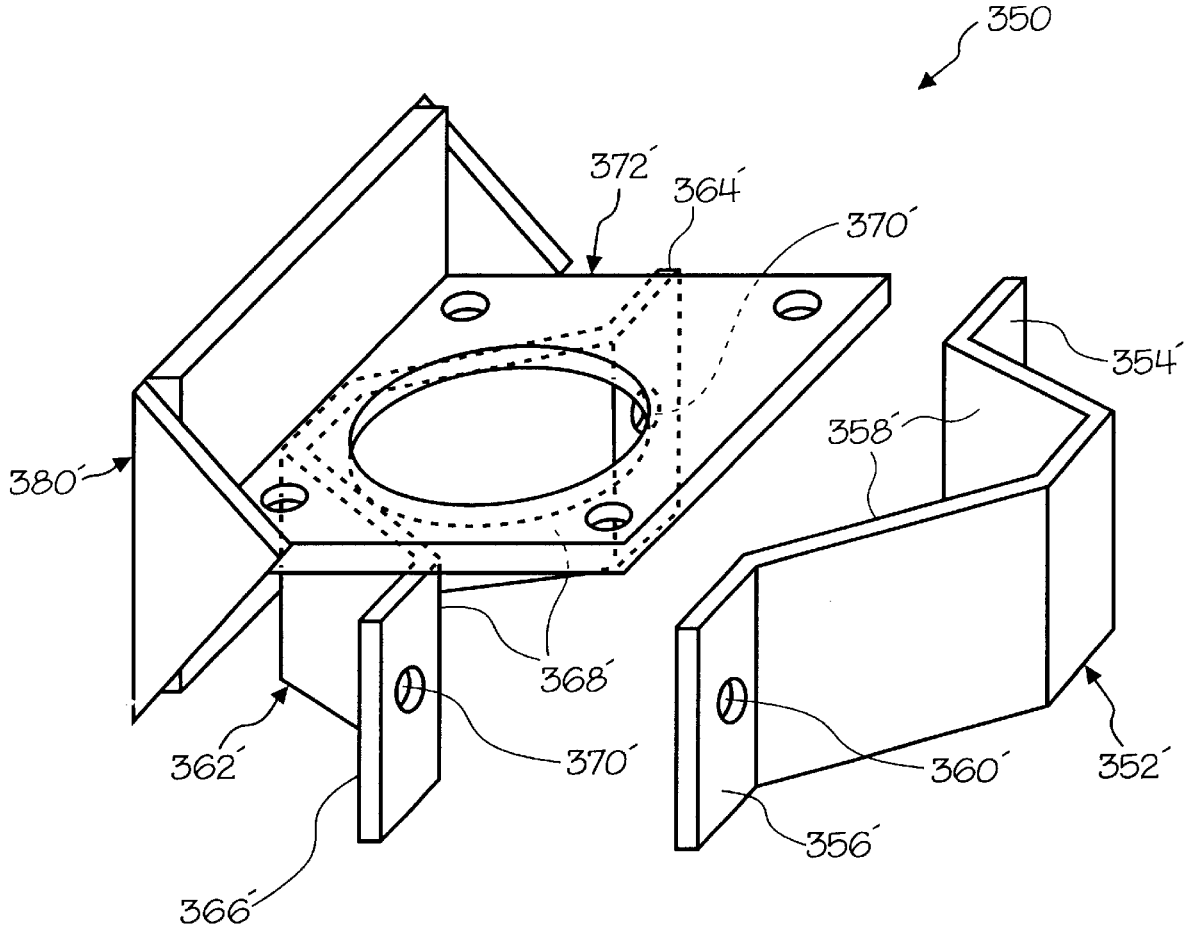
FIG. 5 is an exploded, partial cross-sectional view of an alternative clamp that can be used to secure the metal-transfer conduit without the use of cement.

A preferred adaptor 350' is shown in FIG. 5. Adaptor 350' generally comprises two clamping sections 352' and 362'. As shown, the clamping sections are mirror images of each other; therefore, only section 352' will be described in detail. Section 352' has outer flanges 354' and 356', wherein each of said flanges preferably includes a single circular aperture 360'. Section 352' is formed so as to create two generally flat, angled clamping surfaces 358'. Also shown in FIG. 5 is an elbow connector plate 372' and a mounting plate 380'.

Adaptor 350' is utilized by placing a generally cylindrical riser tube between sections 352' and 362, aligning flanges 354', 364' and 356', 366' and pairs of apertures 360', 370'. Bolts or other connector means are then placed through aligned pairs of aperture 360', 370' to draw sections 352', 354' together. Clamping surfaces 358' and surfaces 368' press against the outer surface of the riser tube and hold it in place. This arrangement is preferred over an adaptor having sections including a semi-cylindrical clamping surface because, with flat clamping surfaces, the circumference of the tube's outer surface need not mate with the clamping surface. Therefore, less care (and less expense) may be used in forming the riser tube.

Clamp 350' having two clamping sections, each of which has two substantially flat clamping surfaces is preferred. Similar results may be achieved, however, if more than two sections are used, or if the respective sections have at least one, or more than two, flat surfaces, although it is preferred that at least one clamping section have at least two substantially flat clamping surfaces. Clamp 350' may also include a protrusion or projection to locate the riser with respect to the pump base, as previously described.

Figure 13:
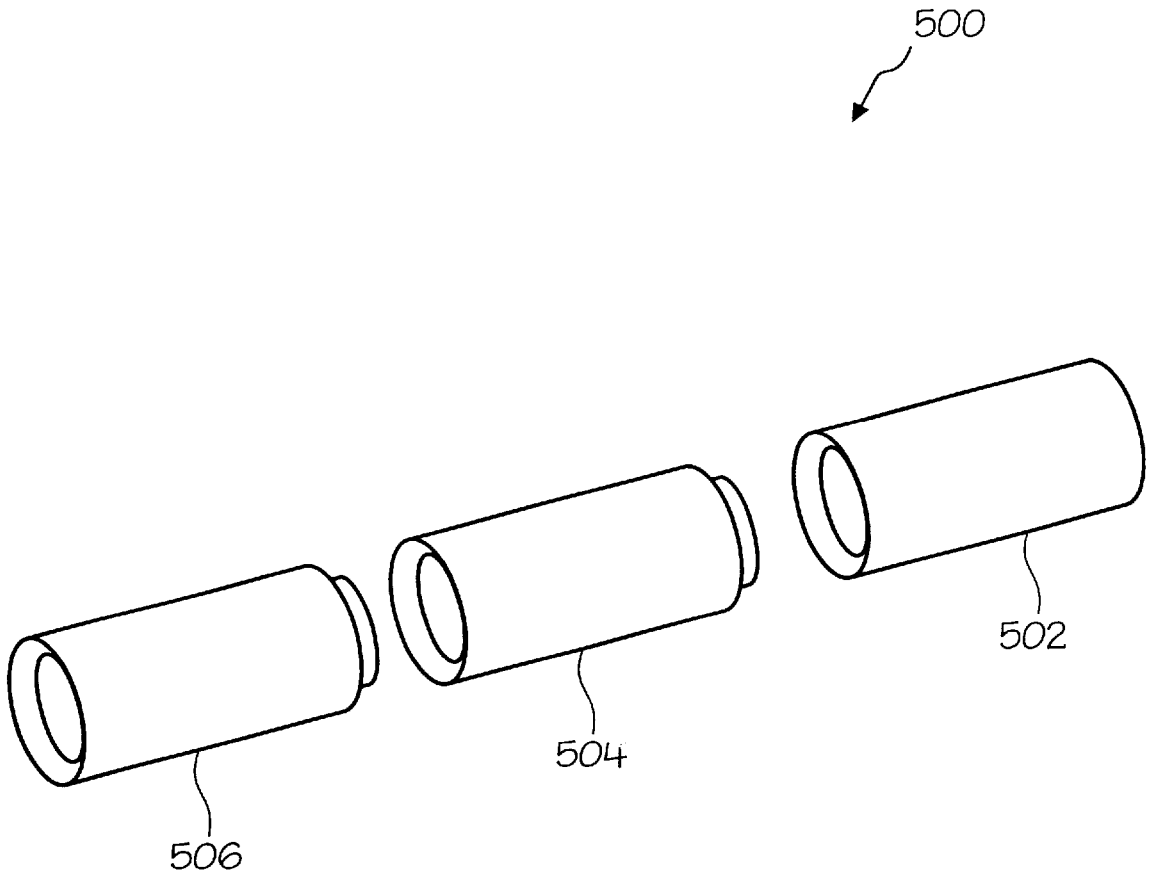
FIG. 13 shows a sectional metal-transfer conduit in accordance with the invention.
Figure 13A:
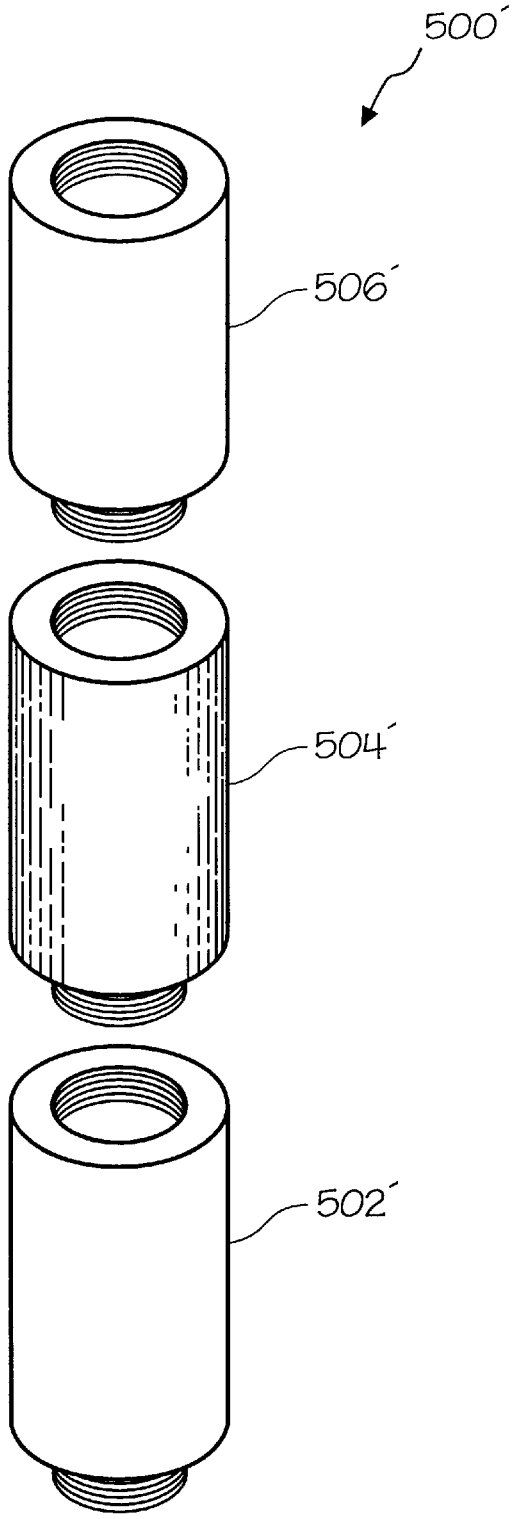
FIG. 13*a* shows an alternative sectional metal-transfer conduit in accordance with the invention.

Conduits 300, 300' and 300" are shown as monolithic pieces. Alternatively, as shown in FIGS. 13 and 13*a*, a sectional metal-transfer conduit 500 or 500' may be provided. Turning to FIG. 13, conduit 500 is formed of three sections, a submersible, or lower section, 502, a center section 504, and an upper section 506 that may connect to an elbow 508, shown in FIG. 1. Sections 502, 504, 506 and elbow 508 may be interconnected with or without the use of cement or other sealant. Additionally, they may be assembled by means of threaded connections.

The value of providing sectional conduit 500 is that the material of which the various sections are formed may be selected to match the conditions to which they will be exposed. The conditions within a molten metal furnace vary greatly from within the metallic bath, to the surface of the metallic bath, to the atmosphere above the bath. When the proper material is used for each environment, the life of the conduit is extended at a minimal cost. For example, the surface of metallic bath B is the most caustic environment to which conduit 500 is exposed. It is therefore desirable to make section 504, which in this embodiment will most often be exposed to the surface, of highly chemically-resistant ceramic. Ceramic is relatively expensive as compared to graphite, however, and graphite is satisfactory for the environment within bath B and the atmosphere above bath B. Therefore, it is preferable to form sections 502 and 506 from graphite.

Alternatively, each section 502, 504, 506 may be formed of graphite. Section 504, which is exposed to the caustic surface of the molten metal bath, wears out more quickly. Because the conduit is modular, however, section 504 above may be replaced instead of replacing the entire conduit 500. This reduces material waste and costs. Further, as explained below, by providing the tube in sections the length of the tube can be varied, according to the height of the pump, simply be adding or subtracting a section of tube. This reduces and simplifies inventory. In summary, by providing a sectional conduit 500, the operational life of the conduit is extended at a minimal cost.

FIG. 13*a* shows another embodiment of the invention wherein sections 503', 504' and 508' are connected by threaded connections.

Figure 16:
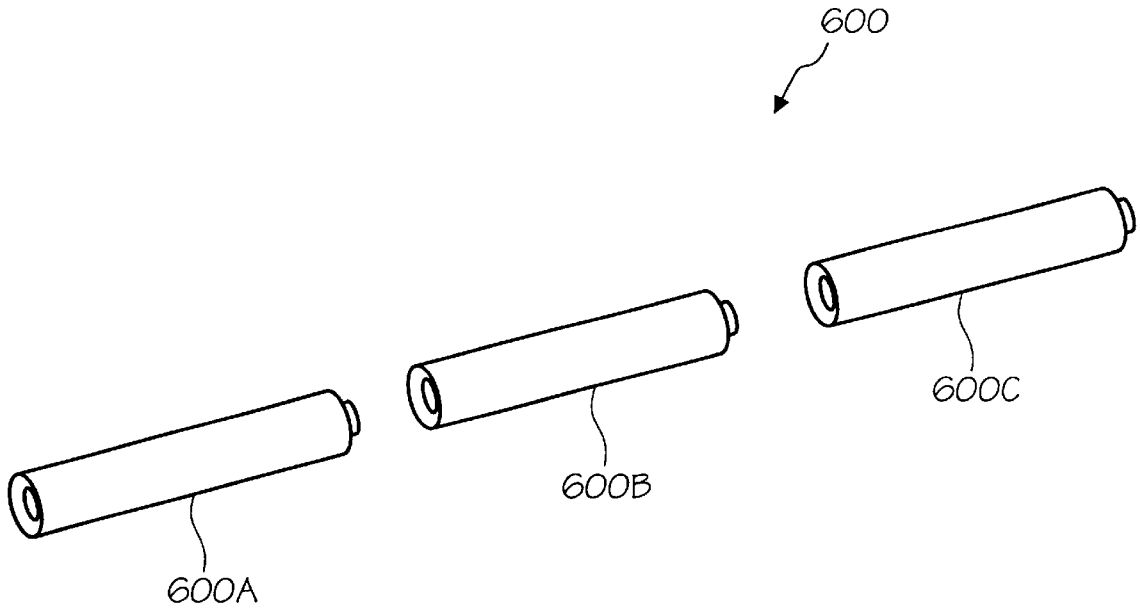
FIG. 16 shows a sectional support post in accordance with the invention.
Figure 17:
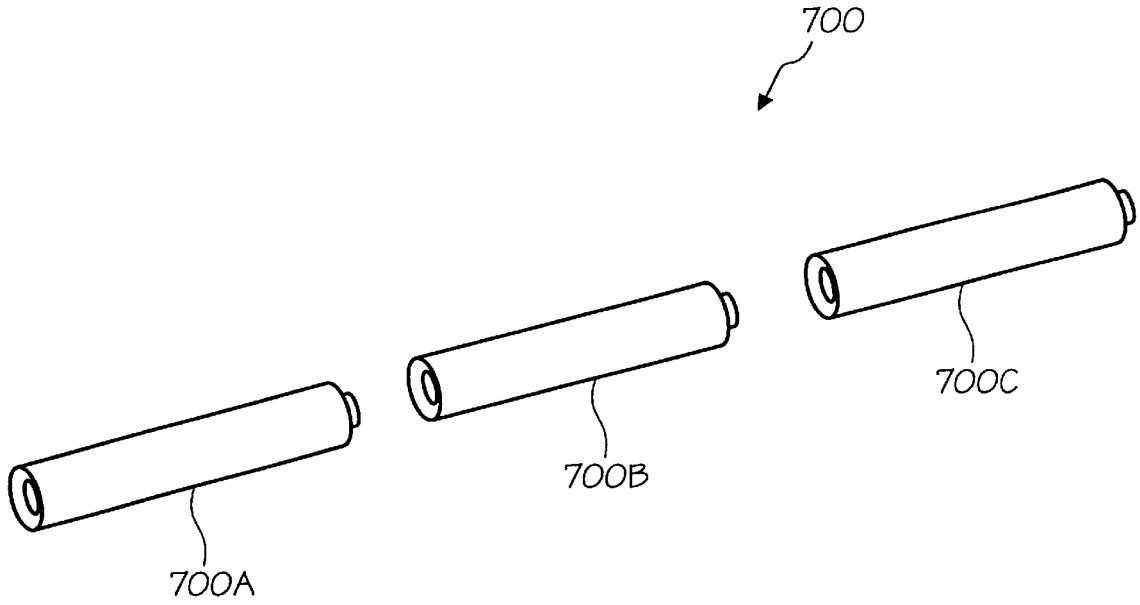
FIG. 17 shows a sectional rotor drive shaft in accordance with the invention.

Additionally, the present pump device can be modular, meaning that the vertical members, specifically the support posts 30 and rotor shaft 40, are sectional. A sectional support post 600 comprising sections 600A, 600B and 600C is shown in FIG. 16. A sectional rotor drive shaft comprising sections 700A, 700B and 700C is shown in FIG. 17. Providing these members as a plurality of sections, rather than as single monolithic pieces, offers two distinct advantages. First, as described above with respect to conduits 300' and 300", the life of the components can be extended at a minimal cost by selecting corrosion-resistant ceramic for the section that contacts the highly corrosive surface of bath B and selecting less expensive graphite for the other sections or, if each section is graphite, the section exposed to the caustic surface, which wears out more quickly than the other sections, can be replaced without having to replace the entire member. Second, molten metal pumps come in different sizes and in varying heights. Currently, a separate inventory of posts and shafts, differing in length according to the height of the pump on which they are to be used, must be maintained for each pump height offered. By making the vertical members described herein sectional, a single inventory of parts can be used and, when the length of a component needs to be increased or decreased to fit the height of a pump, a section can either be added or removed to adjust the height of the component. Although it is preferred that one sectional length be used, the objects of the invention, with respect to this particular aspect, would be achieved as long as there are fewer lengths of sectional components than there are pump heights.

Figure 14:
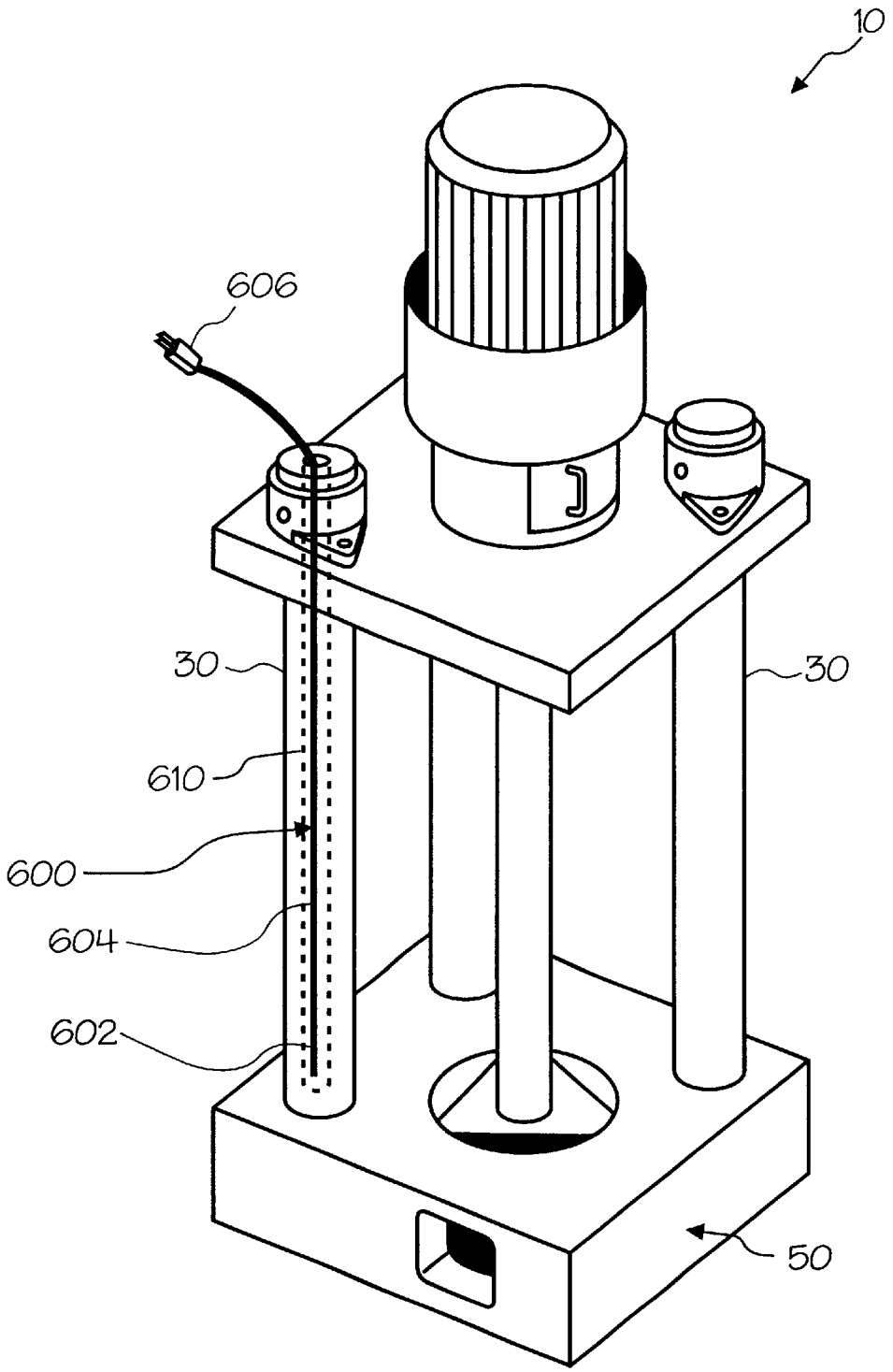
FIG. 14 shows a furnace thermocouple mounted in a support post in accordance with the invention.

Finally, as shown in FIG. 14, the present invention may also be a pump including a thermocouple 600 mounted within a support post 30. Thermocouple 600 includes a temperature-sensing means 602, a cord 604 and a connector 606. In this embodiment, support post 30 includes an axial bore 610 that receives means 602 and cord 604. One advantage of this arrangement is that the thermocouple is not subjected to the caustic environment of the molten metal bath and therefore, has a longer life. Another advantage is that the thermocouple is positioned at one depth within the bath; it is not pushed about by the currents within the bath. Therefore, the temperature reading is more accurate. It is also contemplated that the thermocouple could be embedded or formed within the pump base or another stationary pump component.

A preferred embodiment having now been described, it will be understood that the invention is not thus limited, but is instead set forth in the appended claims and legal equivalents thereof.

What is claimed is:

1. A device for pumping molten metal comprising:

(a) a superstructure;

(b) a motor on the superstructure, the motor connected to a drive shaft;

(c) a pump base having an input port, a pump chamber formed therein, the pump chamber having a chamber wall and a discharge leading to an output port;

(d) a support post connected to the base and to the superstructure, the support post formed of a plurality of interconnected, vertically-aligned sections;

(e) a rotor positioned within the chamber, the rotor having a vane including a section for directing molten metal into the pump chamber and including a section that directs molten metal towards the chamber wall, and a portion of the rotor extending beyond the input port in the pump base to deflect solid particles before the particles enter the pump chamber;

(f) a rotor shaft connected to the rotor, the rotor shaft formed of a plurality of interconnected, vertically-aligned sections;

(g) a coupling for connecting the rotor shaft to the drive shaft;

(h) a metal-transfer conduit forming a connection with the output port without the use of cement or other sealant, the metal-transfer conduit formed of a plurality of interconnected, vertically-aligned sections; and (i) a thermocouple contained within the support post.

2. A device for pumping molten metal, the device comprising:

(a) a motor;

(b) a pump base having an input port, a pump chamber and a discharge leading from the pump chamber to an output port, wherein molten metal enters the base through the input port;

(c) a drive shaft having a first end drivingly connected to the motor, and a second end; and (d) a rotor within the pump chamber, the rotor connected to the second end of the drive shaft and having a portion extending beyond the input port in the pump base, the portion of the rotor extending beyond the input port in the pump base including one or more projections that deflect solid particles thereby preventing the deflected particles from entering the input port, wherein none of the projections is a deflector disk.

3. A transfer pump for pumping molten metal, the transfer pump comprising:

(a) a superstructure;

(b) a motor positioned on the superstructure;

(c) a drive shaft having a first end connected to the motor and a second end;

(d) a pump base having a top surface, an input port, a pump chamber, and a discharge leading from the pump chamber to an output port; and (e) a support post connecting the pump base to the superstructure;

(f) a button having a first end, a second end and a passage extending therethrough, the first end attached to the top surface of the pump base whereby the passage is in fluid communication with the outlet, the second end of the button for connecting to a metal-transfer conduit to facilitate a connection for the transfer of molten metal therebetween;

(g) a rotor positioned in the pump chamber and being connected to the second end of the drive shaft; and (h) a metal-transfer conduit having a first end and a second end, the first end being positioned on the second end of the button to form a connection without the use of cement or other sealant, the connection facilitating the transfer of molten metal from the passage in the button to the metal-transfer conduit, and the second end of the metal transfer conduit being connected to the superstructure.

4. The pump of claim 3 wherein the second end of the button has an angled lip and the first end of the metal-transfer conduit has an angled lip that aligns with the angled lip on the second end of the button.

5. The pump of claim 3 wherein the button has an outer diameter and the metal-transfer conduit has an outer diameter equal to the outer diameter of the button.

6. The pump of claim 3 wherein the second end of the metal-transfer conduit is connected to the superstructure by an adaptor.

7. The pump of claim 6 wherein the adaptor is connected to the superstructure without the use of cement of other sealant.

8. The pump of claim 6 wherein the adaptor has a section that retains the second end of the metal-transfer conduit without the use of cement or other sealant.

9. The pump of claim 8 wherein the adaptor is a two-piece, adjustable adaptor capable of compensating for different diameter metal-transfer conduits.

10. The pump of claim 9 wherein the adaptor includes at least one flat surface for clamping against the outer surface of the metal-transfer conduit to compensate for dimensional variations in the shape of the metal-transfer conduit.

11. The pump of claim 3 that further comprises a gasket positioned between the first end of the metal-transfer conduit and the second end of the button.

12. A method for removing a metal-transfer conduit from a molten metal pumping device, the method comprising the steps of:

(a) providing a molten metal bath;

(b) providing a molten metal pumping device positioned in the molten metal bath, the device including;

i. a superstructure;

ii. a motor positioned on the superstructure;

iii. a pump base having a pump chamber, an input port and a discharge leading from the pump chamber to an output port;

iv. a support post connected to the pump base and connected to the superstructure;

v. a drive shaft having a first end and a second end, the first end connected to the motor;

vi. a rotor connected to the second end of the drive shaft, the rotor positioned within the pump chamber;

vii. an adaptor attached to the superstructure; and viii. a metal-transfer conduit having a first end that forms a connection with the output port without the use of cement or other sealant in order to transfer molten metal from the output port to the metal transfer conduit, and a second end retained by the adaptor and thereby being connected to the superstructure;

(c) removing the device from the molten metal bath;

(d) disconnecting the second end of the metal-transfer conduit from the superstructure without removing any cement or other sealant; and (e) disconnecting the first end of the metal-transfer conduit from the output port without removing any cement or other sealant.

13. The method of claim 12 wherein the pumping device further includes a button having a first end, a second end and a passage formed therethrough, the first end of the button being connected to the output port, such that the passage is in communication with the output port, the first end of the metal-transfer conduit forming a connection with the output port by being positioned on the second end of the button.

14. The method of claim 13 wherein the metal-transfer conduit has an outer diameter and the button has an outer diameter equal to the outer diameter of the metal-transfer conduit.

15. The method of claim 13 wherein the pumping device further includes a gasket positioned between the first end of the metal-transfer conduit and the second end of the button.

16. The method of claim 12 wherein the adaptor is connected to the superstructure without the use of cement or other sealant.

17. The method of claim 12 wherein the adaptor retains the second end of the metal-transfer conduit without the use of cement or other sealant.

18. The method of claim 17 wherein the adaptor is adjustable and includes a flat clamping surface for clamping against the outer surface of the metal-transfer conduit to retain the metal-transfer conduit.

19. A molten metal pumping device including a metal-transfer conduit comprising a plurality of interconnected sections, the device comprising:

(a) a superstructure;

(b) a motor positioned on the superstructure;

(c) a drive shaft having a first end and a second end, the first end being drivingly connected to the motor;

(d) a pump base, the base including an input port, a pump chamber and a discharge leading from the chamber to an output port;

(e) a support post having a first end connected to the base and a second end connected to the superstructure, the support post comprised of a plurality of interconnected vertically-aligned sections, each of the sections having a connecting end, the sections being connected without the use of a separate coupling component by bringing the connecting end of one section into physical contact with the connecting end of another section, each of the sections being comprised of refractory material;

(f) a rotor connected to the second end of the drive shaft and being positioned in the pump chamber; and (g) a metal-transfer conduit extending from the output port to the superstructure, the metal-transfer conduit being connected to the output port without the use of cement or other sealant, the metal-transfer conduit defining a passage therein for the transfer of molten metal and being comprised of a plurality of interconnected, vertically-aligned sections, each of the sections having a connecting end, the sections being connected without the use of a coupling by bringing the connecting end of one section into physical contact with the connecting end of another section, each of the sections being comprised of refractory material.

20. The pumping device of claim 19 the metal transfer conduit wherein at least one of the sections is formed of ceramic and at least one of the sections is formed of graphite.

21. The pumping device of claim 19 the metal transfer conduit wherein the sections are threadingly connected.

22. A molten metal pumping device including a support post comprised of a plurality of sections, the device comprising:

(a) a superstructure;

(b) a motor positioned on the superstructure;

(c) a drive shaft comprised of a motor shaft and a rotor drive shaft, the motor shaft having a first end and a second end, the first end being drivingly connected to the motor, the second end connected to the rotor drive shaft;

(d) a pump base, the base including an input port, a chamber and a discharge leading from the chamber to an output port;

(e) a rotor connected to the rotor drive shaft opposite the motor drive shaft, the rotor being positioned in the chamber; wherein the rotor drive shaft extends from the rotor to the motor shaft, the rotor drive shaft being comprised of a plurality of interconnected, vertically-aligned sections, each of the sections having a connecting end, the sections being connected without the use of a separate coupling component by bringing the connecting end of one section into physical contact with the connecting end of another section, each of the sections being comprised of refractory material; and (f) a support post extending from the base to the superstructure, the support post having a first end connected to the base and a second end connected to the superstructure, the support post comprised of a plurality of interconnected, vertically-aligned sections, each of the sections having a connecting end, the sections being connected without the use of a separate coupling component by bringing the connecting end of one section into physical contact with the connecting end of another section, each of the sections being comprised of refractory material.

23. The pumping device of claim 22 the support post wherein at least one of the sections is formed of ceramic and at least one of the sections is formed of graphite.

24. The pumping device of claim 22 the support post wherein the sections are threadingly connected.

25. A molten metal pumping device including a rotor drive shaft comprised of a plurality of interconnected sections, the device comprising:

(a) a superstructure;

(b) a motor positioned on the superstructure;

(c) a drive shaft comprised of a motor shaft and a rotor drive shaft, the motor shaft having a first end and a second end, the first end drivingly connected to the motor, the second end connected to the rotor drive shaft;

(d) a pump base, the base including an input port, a chamber and a discharge leading from the chamber to an output port;

(e) a rotor connected to the rotor drive shaft opposite the motor drive shaft, the rotor being positioned in the chamber; wherein the rotor drive shaft extends from the rotor to the motor shaft, the rotor drive shaft being comprised of a plurality of interconnected, vertically-aligned sections, each of the sections having a connecting end, the sections being connected without the use of a separate coupling component by bringing the connecting end of one section into physical contact with the connecting end of another section, each of the sections being comprised of refractory material;

(f) a support post connecting the base to the superstructure; and (g) a metal-transfer conduit extending from the output port to the superstructure, the metal-transfer conduit being connected to the output port without the use of cement or other sealant, the metal-transfer conduit defining a passage therein for the transfer of molten metal and being comprised of a plurality of interconnected, vertically-aligned sections, each of the sections having a connecting end, the sections being connected without the use of a coupling by bringing the connecting end of one section into physical contact with the connecting end of another section, each of the sections being comprised of refractory material.

26. The pumping device of claim 25 the rotor drive shaft wherein at least one of the sections is formed of ceramic and at least one of the sections is formed of graphite.

27. The pumping device of claim 25 the rotor drive shaft wherein the sections are threadingly connected.

28. A support post for use in a molten metal pumping device, the support post including a cavity for retention of a thermocouple, a thermocouple being retained in the cavity, the thermocouple for measuring the temperature of molten metal and being positioned below the surface of a molten metal bath when the support post is in use on a molten metal pump.

29. A molten metal pumping device including:

(a) a superstructure;

(b) a motor positioned on the superstructure;

(c) a drive shaft having a first end and a second end, the first end drivingly connected to the motor;

(d) a base, the base including an input port, a chamber and a discharge leading from the chamber to an outlet;

(e) a support post connecting the superstructure to the base;

(f) a rotor connected to the second end of the drive shaft and being positioned in the chamber;

(g) a cavity formed within the molten metal pumping device; and (h) a thermocouple, the thermocouple being positioned within the cavity and being positioned beneath the surface of a molten metal bath when the pumping device is in use, the thermocouple for measuring the temperature of the molten metal bath.

* * * * *